US010766729B1

(12) United States Patent
Mizutani

(10) Patent No.: US 10,766,729 B1
(45) Date of Patent: Sep. 8, 2020

(54) SHEET BINDING DEVICE AND IMAGE FORMING SYSTEM

(71) Applicant: TOSHIBA TEC KABUSHIKI KAISHA, Shinagawa-ku, Tokyo (JP)

(72) Inventor: Kikuo Mizutani, Izu Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 28 days.

(21) Appl. No.: 16/280,368

(22) Filed: Feb. 20, 2019

(51) Int. Cl.

| | |
|---|---|
| ***B65H 29/12*** | (2006.01) |
| ***B42C 1/12*** | (2006.01) |
| ***B42B 5/00*** | (2006.01) |
| ***B65H 37/04*** | (2006.01) |
| ***G03G 15/00*** | (2006.01) |
| ***B65H 35/00*** | (2006.01) |

(52) U.S. Cl.
CPC ..... *B65H 29/12* (2013.01); *B42B 5/00* (2013.01); *B42C 1/12* (2013.01); *B65H 29/125* (2013.01); *B65H 35/0006* (2013.01); *B65H 37/04* (2013.01); *G03G 15/6544* (2013.01); *B65H 2301/43821* (2013.01); *G03G 2215/00839* (2013.01); *G03G 2215/00848* (2013.01)

(58) Field of Classification Search
CPC .. B65H 29/12; B65H 29/125; B65H 35/0066; B65H 2301/43821; G03G 15/6544; G03G 2215/00839; G03G 2215/00848
USPC ..... 270/58.07, 58.08
See application file for complete search history.

(56) References Cited

U.S. PATENT DOCUMENTS

| | | | | |
|---|---|---|---|---|
| 4,427,405 | A * | 1/1984 | Hoshi | B41F 13/56 493/424 |
| 5,449,162 | A * | 9/1995 | Saito | B65H 3/5261 271/122 |
| 6,024,525 | A * | 2/2000 | Yamanaka | B42C 9/0075 412/11 |
| 7,484,721 | B2 * | 2/2009 | Tsukui | B65H 33/04 270/58.07 |
| 7,726,638 | B2 * | 6/2010 | Itagaki | B65H 45/18 270/20.1 |
| 8,393,620 | B2 * | 3/2013 | Doucet | B41F 13/24 271/265.04 |
| 10,031,465 | B2 | 7/2018 | Sunaoshi et al. | |
| 10,202,252 | B2 * | 2/2019 | Mizutani | B65H 29/12 |
| 10,252,877 | B2 * | 4/2019 | Sunaoshi | B65H 35/0066 |
| 2007/0035079 | A1 * | 2/2007 | Yamada | B26D 1/205 270/58.07 |
| 2018/0086590 | A1 | 3/2018 | Mizutani | |
| 2018/0148294 | A1 | 5/2018 | Sunaoshi et al. | |

* cited by examiner

*Primary Examiner* — Leslie A Nicholson, III
(74) *Attorney, Agent, or Firm* — Amin, Turocy & Watson, LLP

(57) ABSTRACT

According to one embodiment, a sheet binding device includes a first mounting part, a second mounting part, and a mounting adjustment part. The first mounting part mounts a tape on an edge part of a sheet bundle. The second mounting part is opposite to the first mounting part in a sheet bundle thickness direction. The mounting adjustment part is capable of adjusting a mounting gap between the first mounting part and the second mounting part based upon a thickness of the sheet bundle. The mounting gap is equal to or smaller than the thickness of the sheet bundle before the sheet bundle is inserted between the first mounting part and the second mounting part.

20 Claims, 16 Drawing Sheets

SHEET BINDING DEVICE AND IMAGE FORMING SYSTEM

FIELD

Embodiments described herein relate generally to a sheet binding device, an image forming system, and related methods.

BACKGROUND

In the related art, a sheet binding device that binds an edge part of a sheet bundle by using an adhesive tape is known. The sheet binding device is provided with a bundle forming part and a tape mounting part. The bundle forming part forms a sheet bundle by stacking a plurality of sheets. The bundle forming part forms a side part of the sheet bundle in a stepwise shape in order to secure a surface area when the tape is mounted thereon. The tape mounting part binds the sheet bundle by mounting the adhesive tape on the edge part of the sheet bundle. The tape mounting part is provided with a tape holding part that holds the adhesive tape. The tape mounting part is provided with a first roller and a second roller that are opposite to each other in a sheet bundle thickness direction. The adhesive tape is peeled from the tape holding part by inserting the sheet bundle shifted in the stepwise shape toward the adhesive tape held by the tape holding part. Thereafter, the sheet bundle enters between the first roller and the second roller together with the adhesive tape, and the adhesive tape adheres to the edge part of the sheet bundle.

However, the following problem may occur depending on a relationship between a thickness of the sheet bundle and a roller gap between the first roller and the second roller. For example, when the roller gap therebetween is too narrow with respect to the thickness of the sheet bundle, the sheet bundle cannot enter between the first roller and the second roller. On the other hand, for example, when the roller gap is too wide with respect to the thickness of the sheet bundle, the adhesive tape cannot sufficiently adhere to the edge part of the sheet bundle.

BRIEF DESCRIPTION OF THE DRAWINGS

FIGS. 3A and 3B are side views illustrating an operation in which a shift amount between sheets is changed, wherein FIG. 3A is a diagram illustrating a case in which the shift amount between the sheets is relatively small, and FIG. 3B is a diagram illustrating a case in which the shift amount between the sheets is relatively large;

DETAILED DESCRIPTION

In general, according to one embodiment, a sheet binding device includes a first mounting part, a second mounting part, and a mounting adjustment part. The first mounting part mounts a tape on an edge part of a sheet bundle. The second mounting part is opposite to the first mounting part in a sheet bundle thickness direction. The mounting adjustment part can adjust a mounting gap between the first mounting part and the second mounting part based upon a thickness of the sheet bundle. The mounting gap is equal to or smaller than the thickness of the sheet bundle before the sheet bundle is inserted between the first mounting part and the second mounting part.

Hereinafter, the sheet binding device and an image forming system of the embodiment will be described with reference to the accompanying drawings. Further, in each drawing, the same configuration will be denoted by the same reference sign. Accordingly, redundant descriptions of those configurations may be omitted. Further, in the present application, various sheet-shaped media including paper and the like are referred to as a "sheet".

First, one embodiment will be described with reference to FIGS. 1 to 10.

Figure 1:
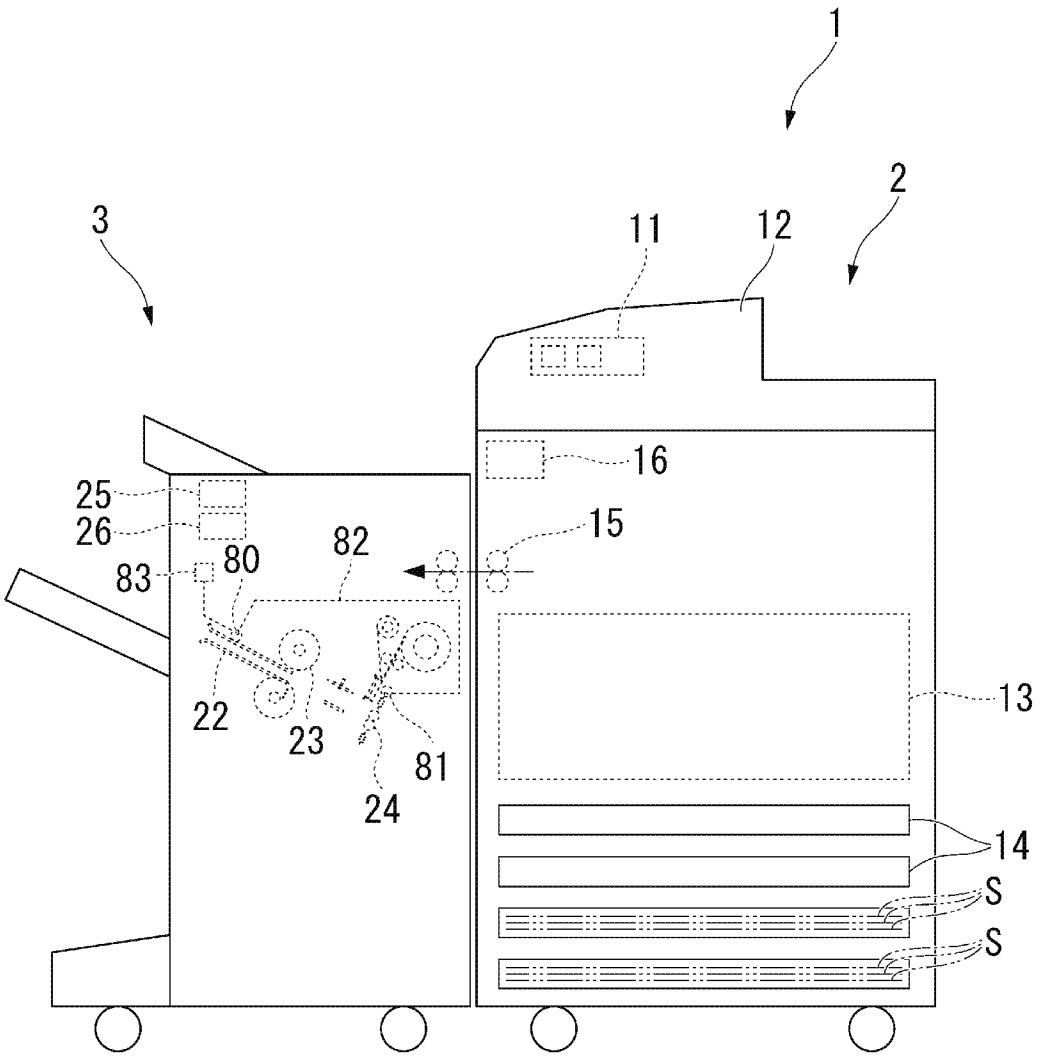
FIG. 1 is a front view illustrating an image forming system of a first embodiment.

FIG. 1 is a front view illustrating an image forming system 1 according to the embodiment. The image forming system 1 of the embodiment is provided with a sheet binding device 3 that binds an edge part 5*a* of a sheet bundle 5 (refer to FIG. 9) with a tape. For example, the sheet binding device 3 is a post-processing device that is disposed adjacent to an image forming device 2 and performs post-processing on a sheet S conveyed from the image forming device 2.

Here, first the image forming device 2 will be briefly described.

As illustrated in FIG. 1, the image forming device 2 is provided with a control panel 11, a scanner part 12, a printer part 13, a paper feed part 14, a paper discharge part 15, and a control part 16.

The control panel 11 is provided with various keys and the like. The control panel 11 receives a user's operation.

The scanner part 12 reads image information of a copy object.

The printer part 13 forms an image on the sheet S based upon the image information received from the scanner part 12 or an external device.

The paper feed part 14 supplies the sheet S to the printer part 13.

The paper discharge part 15 conveys the sheet S discharged from the printer part 13 to the sheet binding device 3.

The control part 16 controls various operations of the control panel 11, the scanner part 12, the printer part 13, the paper feed part 14, and the paper discharge part 15.

Next, the sheet binding device 3 will be described.

The sheet binding device 3 is provided with a bundle forming part 22, a sheet shifting part 23, a tape processing part 24, an inter-guide adjustment part 80, a mounting adjustment part 81, an interlocking mechanism 82, an operation part 83, a storage part 25, and a control part 26.

Next, the bundle forming part 22 will be described.

Figure 2:
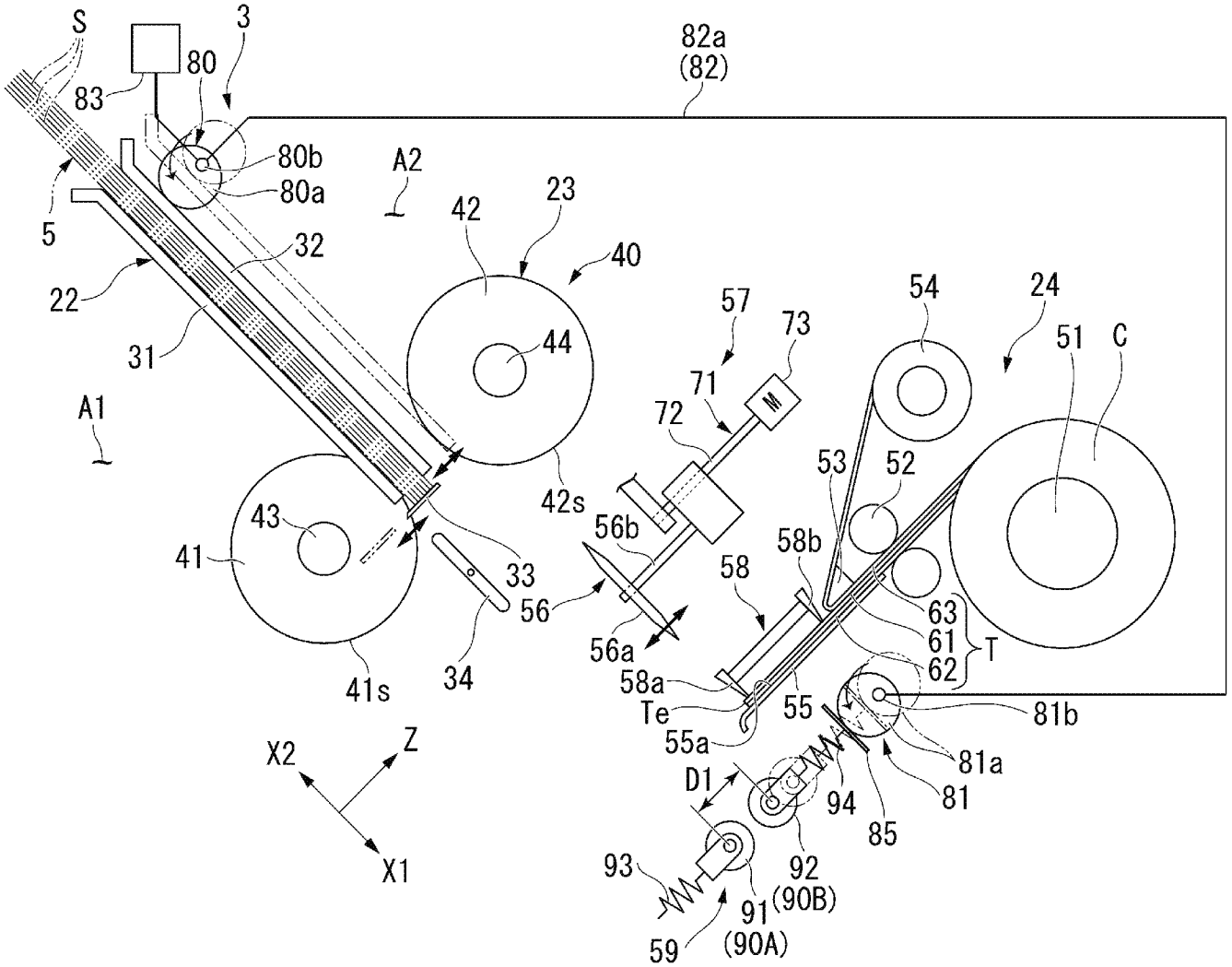
FIG. 2 is a front view illustrating an internal configuration of a sheet binding device according to the first embodiment.

FIG. 2 is a front view illustrating an internal configuration of the sheet binding device 3.

As illustrated in FIG. 2, the bundle forming part 22 forms the sheet bundle 5 by stacking a plurality of the sheets S. The bundle forming part 22 is provided with a main guide 31 (a first guide), a sub guide 32 (a second guide), a stopper 33, a switching member 34.

The main guide 31 guides the sheet S along a sheet conveying direction X1. A plurality of the sheets S are sequentially stacked on the main guide 31, thereby forming the sheet bundle 5. The main guide 31 guides the sheet bundle 5 toward a space between a first roller 91 and a second roller 92. The main guide 31 guides the sheet bundle 5 so that an edge tip of the sheet bundle 5 faces an inside of a width D1 between a center of the first roller 91 and a center of the second roller 92. A downstream side end part of the main guide 31 in the sheet conveying direction X1 is formed in a comb-teeth shape so as to avoid the first roller 41 of the sheet shifting part 23.

The sub guide 32 is opposite to the main guide 31 in a thickness direction Z of the sheet bundle 5 (hereinafter referred to as a "sheet bundle thickness direction Z"). A space for loading the sheet S is provided between the main guide 31 and the sub guide 32. A downstream side end part of the sub guide 32 in the sheet conveying direction X1 is formed in a comb-teeth shape so as to avoid the second roller 42 of the sheet shifting part 23.

The stopper 33 is provided at the downstream side end part of the main guide 31 in the sheet conveying direction X1. The stopper 33 is movable between a regulating position (indicated by a solid line in FIG. 2) and a releasing position (indicated by a two-dot chain line in FIG. 2) by a moving mechanism which is not illustrated. At the regulating position, the stopper 33 protrudes upward further than an upper surface of the main guide 31. At the regulating position, the stopper 33 stops the sheet S in such a manner that an end part of the sheet S abuts on the stopper 33. Therefore, the sheet S is accumulated on the main guide 31, thereby forming the sheet bundle 5. On the other hand, at the releasing position, the stopper 33 is retracted downward further than the upper surface of the main guide 31. At the releasing position, the stopper 33 allows the sheet bundle 5 on the main guide 31 to pass through toward the switching member 34.

The switching member 34 switches a conveying path of the sheet bundle 5. Hereinafter, a direction in which the sheet bundle 5 is conveyed toward the tape processing part 24 (specifically, a tape mounting part 59) is referred to as a "first conveying direction (an inserting direction)". On the other hand, a direction in which the sheet bundle 5 is conveyed toward a position (for example, a position below the bundle forming part 22) different from the tape mounting part 59 is referred to as a "second conveying direction". The switching member 34 switches the conveying path of the sheet bundle 5 between the first conveying direction and the second conveying direction.

Next, the sheet shifting part 23 will be described.

The sheet shifting part 23 forms a state in which the plurality of sheets S forming the sheet bundle 5 are shifted from each other at the edge part 5*a* of the sheet bundle 5 by sequentially shifting the plurality of sheets S in the sheet conveying direction X1 little by little. For example, the sheet shifting part 23 forms a state in which the plurality of sheets S are shifted in a stepwise shape at the edge part 5*a* of the sheet bundle 5.

The sheet shifting part 23 is provided with the first roller 41 and the second roller 42. The first roller 41 and the second roller 42 form an example of a "bundle conveying part 40" in cooperation with each other. The bundle conveying part 40 conveys the sheet bundle 5 sandwiched between the main guide 31 and the sub guide 32 toward the space between the first roller 91 (a first mounting part 90A) and the second roller 92 (a second mounting part 90B).

The first roller 41 is mounted on a first shaft 43. For example, the first roller 41 is a driven roller that rotates according to rotation of the second roller 42. The first roller 41 is fixed at a fixed position.

The second roller 42 is mounted on a second shaft 44. The second roller 42 is a drive roller driven by a motor (not illustrated) through the second shaft 44. The second roller 42 is movable in a direction approaching the first roller 41 and a direction away from the first roller 41 by a moving mechanism which is not illustrated. As the second roller 42 is moved toward the first roller 41, the second roller 42 contacts the sheet bundle 5 from a side opposite to the first roller 41. A material of the second roller 42 is not particularly limited. For example, the second roller 42 is formed of ethylene propylene diene rubber (EPDM).

Here, an outer peripheral surface 41*s* of the first roller 41 is softer than an outer peripheral surface 42*s* of the second roller 42, and is deformable along the surface of the sheet bundle 5. For example, the first roller 41 is formed of a sponge or rubber and the like having a cavity therein. When the second roller 42 approaches the first roller 41, the outer peripheral surface 41*s* of the first roller 41 is deformed into a circular arc shape along the outer peripheral surface 42*s* of the second roller 42 together with the sheet bundle 5 (refer to FIGS. 3A and 3B).

Figure 3A:
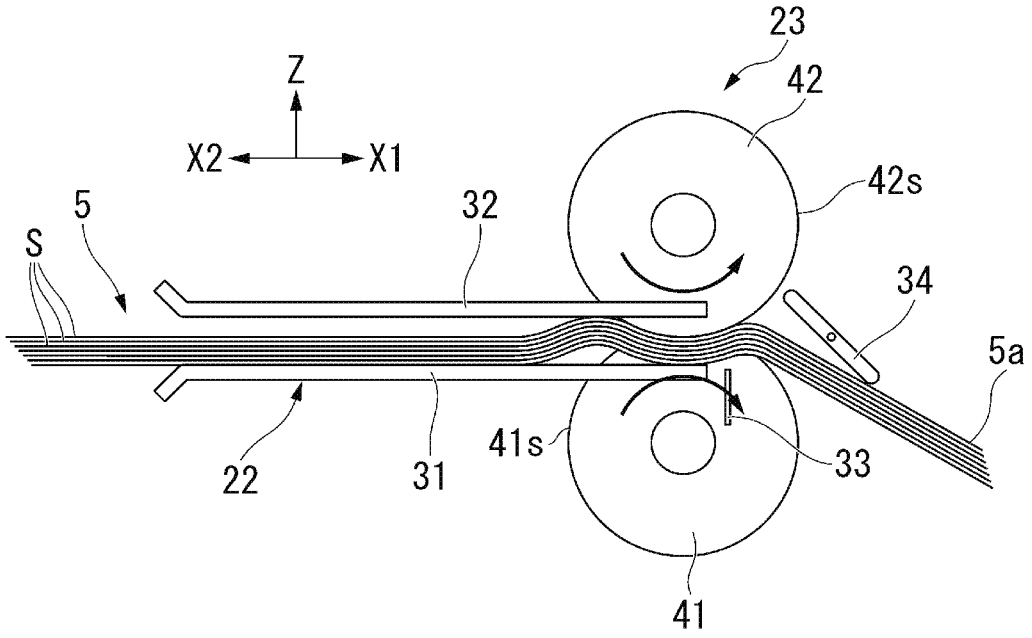
Figure 3B:
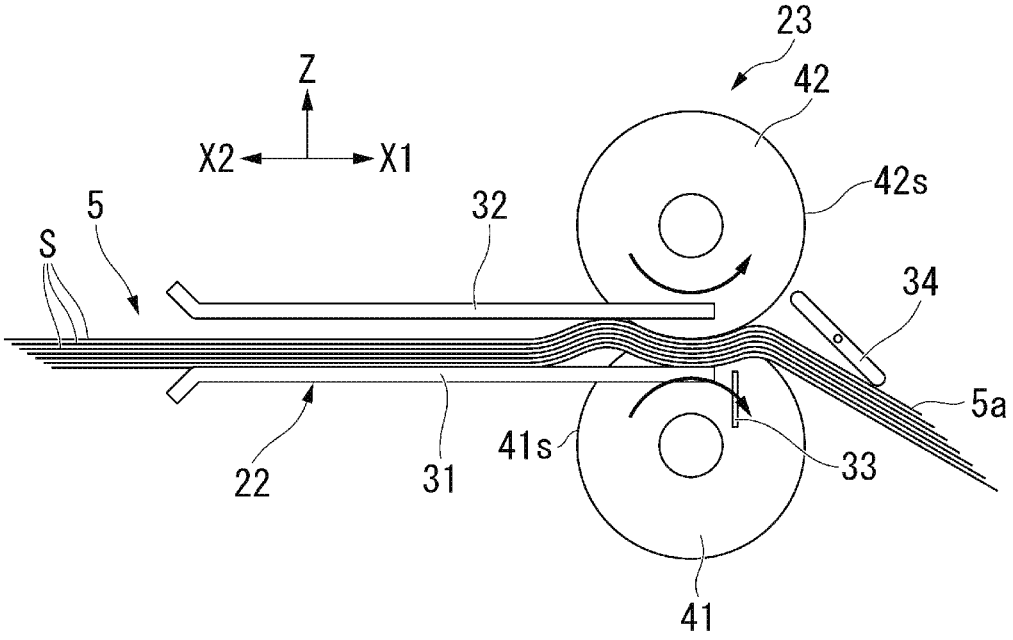

FIGS. 3A and 3B are side views illustrating an operation in which a shift amount d between the sheets S is changed by the sheet shifting part 23. FIG. 3A is a diagram illustrating a case in which the shift amount d between the sheets S is relatively small. On the other hand, FIG. 3B is a diagram illustrating a case in which the shift amount d between the sheets S is relatively large.

As illustrated in FIGS. 3A and 3B, the sheet shifting part 23 can reduce the shift amount d between the sheets S by setting a rotating angle of the second roller 42 to be smaller than a preset reference amount. On the other hand, the sheet shifting part 23 can increase the shift amount d between the sheets S by setting the rotating angle of the second roller 42 to be greater than the reference amount.

Next, the tape processing part 24 will be described.

As illustrated in FIG. 2, the tape processing part 24 is provided with an unwinding part 51, a tape conveying part 52, a separating member 53, a winding part 54, a guide table 55, a cutter 56, a cutting length changing part 57, a tape holding part 58, and the tape mounting part 59.

The unwinding part 51 is an example of a "tape supplying part". For example, the unwinding part 51 holds a raw web roll around which a belt-shaped tape T (hereinafter simply referred to as a "tape T") is wound. The unwinding part 51 supplies the tape T along a length direction of the tape T. Further, the tape T includes an adhesive layer 61, a protective film (a first film) 62, and a release film (a second film) 63 in a state of being held in the unwinding part 51. The protective film 62 covers the adhesive layer 61 from one side. The protective film 62 is integrated with the adhesive layer 61 when the tape T is used. On the other hand, the release film 63 covers the adhesive layer 61 from the side opposite to the protective film 62. The release film 63 is released from the adhesive layer 61 before the tape T is used. The release film 63 is wound up by the separating member 53 and the winding part 54.

The tape conveying part 52 conveys the tape T supplied from the unwinding part 51 along the length direction of the tape T. For example, the length direction of the tape T is a direction approximately parallel to the sheet bundle thickness direction Z. For example, the tape conveying part 52 is a pair of conveying rollers for conveying the tape T.

The guide table 55 is an example of a tape conveying guide forming a conveying path of the tape T. The guide table 55 guides the tape T from which the release film 63 is separated. The guide table 55 supports the tape T when the tape T is held and cut. A conveying direction of the tape T (the length direction of the tape T) intersects with a vertical surface.

The cutter 56 cuts the belt-shaped tape T supplied from the unwinding part 51, thereby forming a sheet-like tape T. For example, the cutter 56 is a rotor cutter. The cutter 56 includes a cutting blade 56*a* and a supporting shaft 56*b*. The cutting blade 56*a* is rotationally driven in such a manner that the supporting shaft 56*b* is rotated by a motor which is not illustrated. Further, a configuration of the cutter 56 is not limited to the above-mentioned example. The configuration of the cutter 56 may be any configuration as long as the tape T supplied from the unwinding part 51 can be cut. The cutter 56 is movable in a direction approaching the tape T and a direction away from the tape T by a moving mechanism which is not illustrated.

The cutting length changing part 57 changes a length L (refer to FIG. 7) of the tape T cut by the cutter 56. Further, "the length L of the tape" in the present application is a length (a width) of the tape T in the sheet bundle thickness direction Z. In other words, the "tape length L" is a length in a direction of wrapping the edge part 5*a* of the sheet bundle 5 from the first surface 7*a* of the sheet bundle 5 toward the second surface 7*b* thereof.

The cutting length changing part 57 includes a moving mechanism 71 that changes a relative position of the cutter 56 with respect to a tip Te of the tape T supplied from the unwinding part 51. For example, the moving mechanism 71 changes the relative position of the cutter 56 with respect to the tip Te of the tape T by moving the cutter 56. For example, the moving mechanism 71 moves the cutter 56 along the sheet bundle thickness direction Z. Further, "the relative position of the cutter 56 with respect to the tip Te of the tape T" is, for example, the relative position of the cutter 56 with respect to the tip Te of the tape T when the tape T is cut by the cutter 56.

In the embodiment, the moving mechanism 71 is provided with a supporting member 72 supporting the cutter 56, and a drive source 73 moving the cutter 56 via the supporting member 72. For example, the supporting member 72 is a ball screw connected to the cutter 56. The drive source 73 is a motor for moving the cutter 56 by driving the ball screw. Further, configurations of the supporting member 72 and the drive source 73 are not limited to the above-mentioned example. For example, the supporting member 72 may be a cam and the like abutting on the cutter 56. The drive source 73 may be a solenoid and the like for moving the cutter 56 via the supporting member 72. In this case, the supporting member 72 is a connecting member that connects the cutter 56 and the solenoid.

Further, a configuration of the moving mechanism 71 is not limited to the above-mentioned example. For example, the moving mechanism 71 may change the relative position of the cutter 56 with respect to the tip Te of the tape T by changing a feed length of the tape T with respect to the cutter 56 fixed at a fixed position.

In the embodiment, the cutting length changing part 57 is controlled by the control part 26 (refer to FIG. 1). For example, the control part 26 moves the cutter 56 by controlling the drive source 73 of the cutting length changing part 57, thereby changing the length L of the tape T cut by the cutter 56. For example, an operation of the cutting length changing part 57 described hereinbelow is performed in such a manner that the cutting length changing part 57 is controlled by the control part 26.

In the embodiment, the cutting length changing part 57 changes the length of the tape T cut by the cutter 56 based upon the shift amount d between the sheets S changed by the control part 26. For example, when the shift amount d between the sheets S is increased by the control part 26, the cutting length changing part 57 lengthens the length L of the tape T cut by the cutter 56. On the other hand, when the shift amount d between the sheets S is reduced by the control part 26, the cutting length changing part 57 shortens the length L of the tape T cut by the cutter 56.

The tape holding part 58 supports the tape T in a state of holding an attitude of the tape T approximately flat. The tape holding part 58 is movable along the length direction of the tape T by a moving mechanism which is not illustrated. Further, the tape holding part 58 is movable in a direction approaching the tape T and a direction separating from the tape T by the moving mechanism which is not illustrated.

The tape holding part 58 is provided with a first tape supporting part 58*a* and a second tape supporting part 58*b* for supporting the tape T. Each of the first tape supporting part 58*a* and the second tape supporting part 58*b* extends along an inserting direction of the sheet bundle 5 (the sheet conveying direction X1). The first tape supporting part 58*a* and the second tape supporting part 58*b* are disposed with a space therebetween in the conveying direction of the tape T (the sheet bundle thickness direction Z). Each of the first tape supporting part 58*a* and the second tape supporting part 58*b* has a sharply tapered shape toward an adhesive surface of the tape T (an adhesive surface of the adhesive layer 61).

The tape mounting part 59 (a tape wrapping part) is provided with the first roller 91, the second roller 92, a first spring 93 (a first urging member), and a second spring 94 (a second urging member). The first roller 91 and the second roller 92 are arranged in the conveying direction of the tape T (the sheet bundle thickness direction Z). The first spring 93 urges the first roller 91 toward the second roller 92. The second spring 94 urges the second roller 92 toward the first roller 91. The first roller 91 and the first spring 93 form an example of "a first urging part (the first mounting part 90A)" in cooperation with each other. The second roller 92 and the second spring 94 form an example of "a second urging part (the second mounting part 90B)" in cooperation with each other. The edge part 5*a* of the sheet bundle 5 is inserted between the first roller 91 and the second roller 92 together with the tape T when the tape T is mounted. Accordingly, the tape T is bent by the tape mounting part 59 so as to wrap the edge part 5*a* of the sheet bundle 5, and the tape T is mounted on the edge part 5*a* of the sheet bundle 5.

Next, the inter-guide adjustment part 80 will be described.

The inter-guide adjustment part 80 can adjust a guide gap between the main guide 31 and the sub guide 32. The guide gap therebetween is set based upon the thickness of the sheet bundle 5. The inter-guide adjustment part 80 is provided with an eccentric cam 80*a* (hereinafter referred to as a "guide side cam 80*a*") capable of adjusting the guide gap. The guide side cam 80*a* allows the sub guide 32 to be close to or to be away from the main guide 31. A rotating shaft 80*b* of the guide side cam 80*a* is shifted from a center position of the guide side cam 80*a*. The guide side cam 80*a* has a perfect circular outer shape. Further, the outer shape of the guide side cam 80*a* is not limited to the above-mentioned example. For example, the outer shape of the guide side cam 80*a* may be an elliptical shape.

The guide side cam 80*a* abuts on the sub guide 32. The guide side cam 80*a* adjusts the guide gap by rotating around the rotating shaft 80*b*. The guide side cam 80*a* can move the sub guide 32 between a close position (indicated by a solid line in FIG. 2) and a separate position (indicated by a two-dot chain line in FIG. 2) in such a manner that the guide side cam 80*a* rotates around the rotating shaft 80*b*.

Next, the mounting adjustment part 81 will be described.

Figure 4:
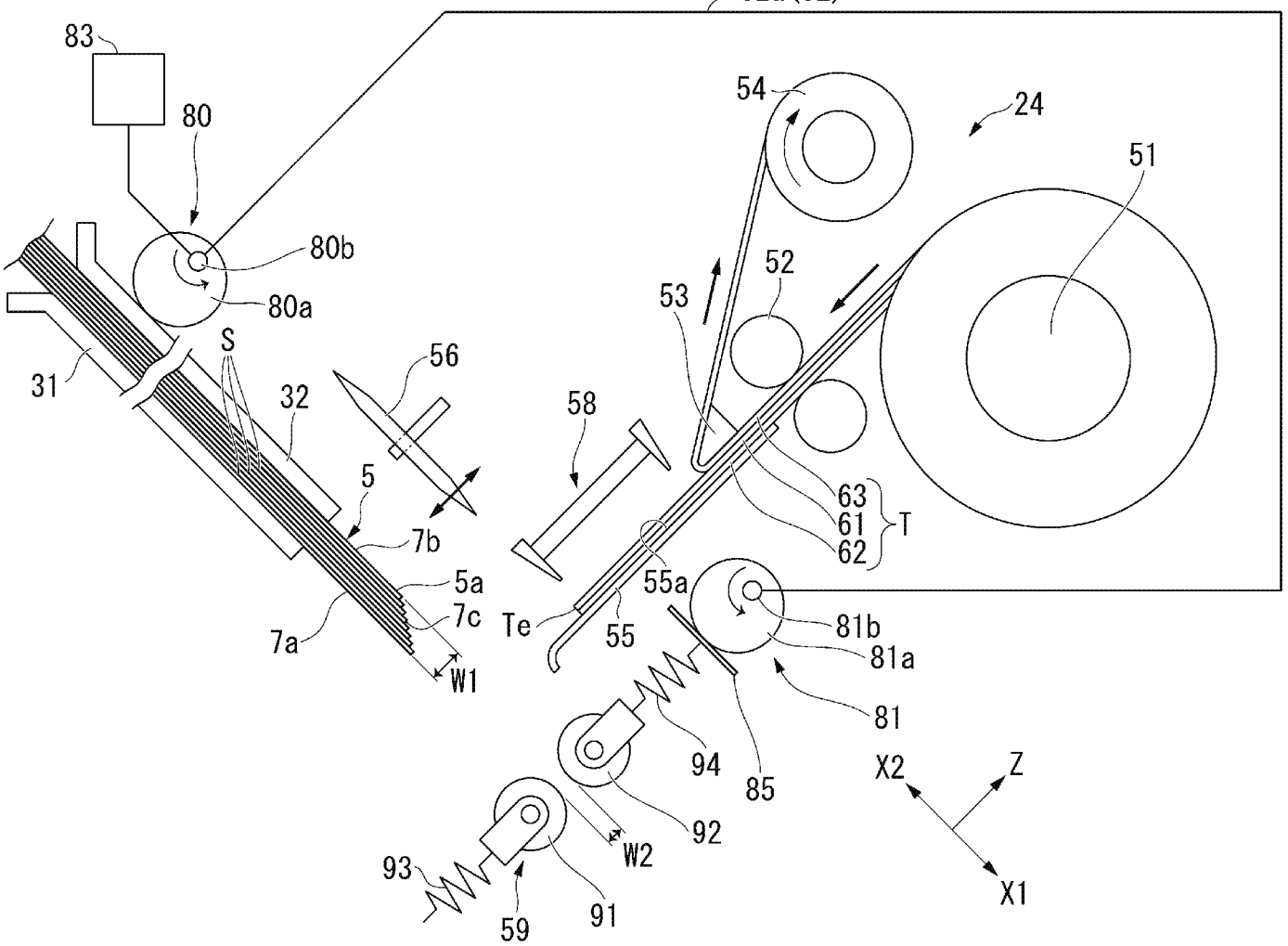
FIG. 4 is a front view illustrating an operation of the sheet binding device according to the first embodiment.

The mounting adjustment part 81 can adjust a roller gap (hereinafter referred to as a "mounting gap") between the first roller 91 and the second roller 92 based upon the thickness of the sheet bundle 5. In FIG. 4, a reference sign W1 indicates the thickness of the sheet bundle 5 and a reference sign W2 indicates the mounting gap. The mounting gap W2 is equal to or smaller than the thickness W1 of the sheet bundle 5 (W2 W1) before the sheet bundle 5 is inserted between the first roller 91 and the second roller 92. In the embodiment, the mounting gap W2 is greater than zero and smaller than the thickness W1 of the sheet bundle 5 (0<W2<W1) before the sheet bundle 5 is inserted between the first roller 91 and the second roller 92.

As illustrated in FIG. 2, the mounting adjustment part 81 is provided with an eccentric cam 81*a* (hereinafter referred to as a "mounting side cam 81*a*") capable of adjusting the mounting gap W2. The mounting side cam 81*a* allows the second roller 92 to be close to or to be away from the first roller 91. A rotating shaft 81*b* of the mounting side cam 81*a* is shifted from a center position of the mounting side cam 81*a*. The mounting side cam 81*a* has a perfect circular outer shape. Further, the outer shape of the mounting side cam 81*a* is not limited to the above-mentioned example. For example, the outer shape of the mounting side cam 81*a* may be an elliptical shape.

A reference sign 85 in the drawing indicates a supporting plate that supports a base end of the second spring 94. The mounting side cam 81*a* abuts on the supporting plate 85. The mounting side cam 81*a* adjusts the mounting gap by rotating around the rotating shaft 81*b*. The mounting side cam 81*a* can move the second roller 92 between a close position (indicated by a two-dot chain line in FIG. 2) and a separate position (indicated by a solid line in FIG. 2) in such a manner that the mounting side cam 81*a* rotates around the rotating shaft 81*b*.

In the embodiment, the mounting side cam 81*a* has substantially the same outer shape as that of the guide side cam 80*a*. An adjustment amount of the mounting adjustment part 81 (an adjustment amount of the mounting gap) is substantially the same as an adjustment amount of the inter-guide adjustment part 80 (an adjustment amount of the guide gap).

Each of the guide side cam 80*a* and the mounting side cam 81*a* is positioned in one side of two regions partitioned by the sheet bundle 5 in the sheet bundle thickness direction Z. In the drawing, a reference sign A1 indicates a first region partitioned by the sheet bundle 5 in the sheet bundle thickness direction Z, and a reference sign A2 indicates a second region partitioned by the sheet bundle 5 in the sheet bundle thickness direction Z. In the embodiment, the guide side cam 80*a* and the mounting side cam 81*a* are positioned in the second region A2.

Next, the interlocking mechanism 82 will be described.

The interlocking mechanism 82 allows the inter-guide adjustment part 80 and the mounting adjustment part 81 to be interlocked with each other. In the embodiment, the interlocking mechanism 82 allows the inter-guide adjustment part 80 and the mounting adjustment part 81 to be interlocked with each other so that the mounting gap becomes gradually narrower as the guide gap becomes narrower. Additionally, the interlocking mechanism 82 allows the inter-guide adjustment part 80 and the mounting adjustment part 81 to be interlocked with each other so that the mounting gap gradually becomes wider as the guide gap becomes wider.

A pressing force (an urging force of the urging member) with respect to the sheet bundle 5 between the first roller 91 and the second roller 92 becomes greater as the guide gap becomes narrower. On the other hand, the pressing force becomes smaller as the guide gap becomes wider. Further, the pressing force may be increased after the sheet bundle 5 is inserted between the first roller 91 and the second roller 92.

The interlocking mechanism 82 is provided with a power transmission mechanism 82*a* that transmits a rotational force of the guide side cam 80*a* to the mounting side cam 81*a*. For example, the power transmission mechanism 82*a* is provided with a belt and a pulley which are not illustrated. Further, a configuration of the power transmission mechanism 82*a* is not limited to the above-mentioned example. For example, the power transmission mechanism 82*a* may be provided with a plurality of gears.

The operation part 83 is a member for rotating the guide side cam 80*a* around the rotating shaft 80*b* of the guide side cam 80*a*. For example, the operation part 83 is a knob provided outside the sheet binding device 3. For example, by operating the knob, the guide side cam 80*a* rotates around the rotating shaft 80*b* of the guide side cam 80*a*. Accordingly, the mounting side cam 81*a* rotates around the rotating shaft 81*b* of the mounting side cam 81*a* according to the rotation of the guide side cam 80*a*. As a result, the guide gap and the mounting gap are interlocked with each other, thereby being adjusted.

The control part 26 (refer to FIG. 1) is formed by a control circuit including a CPU, a ROM, and a RAM provided in the sheet binding device 3. The control part 26 controls the operation of the sheet binding device 3, for example, in such a manner that a processor such as a CPU executes a program. For example, the control part 26 controls various operations of the bundle forming part 22, the sheet shifting part 23, and the tape processing part 24.

Next, an operation example of the sheet binding device 3 will be described. FIGS. 4 to 10 are front views illustrating the operation example of the sheet binding device 3.

First, as illustrated in FIG. 2, the sheet binding device 3 stops the sheet S conveyed to the main guide 31 by moving the stopper 33 to the regulating position. Accordingly, the plurality of sheets S are sequentially stacked on each other, thereby forming the sheet bundle 5. Next, the sheet binding device 3 moves the stopper 33 to the releasing position. Further, the sheet binding device 3 switches the switching member 34 toward the second conveying direction.

Next, as illustrated in FIGS. 3A and 3B, the sheet binding device 3 moves the second roller 42 toward the first roller 41. Thus, the sheet bundle 5 and the outer peripheral surface 41*s* of the first roller 41 are deformed into circular arc shapes along the outer peripheral surface 42*s* of the second roller 42. The sheet binding device 3 normally rotates the second roller 42 in a state where the sheet bundle 5 is sandwiched between the first roller 41 and the second roller 42.

Thus, the first roller 41 rotates according to the rotation of the second roller 42 while maintaining a state in which the first roller 41 is recessed so as to follow the outer peripheral surface 42*s* of the second roller 42. As a result, a state in which the plurality of sheets S are shifted in the stepwise shape in the sheet conveying direction X1 at the edge part 5*a* of the sheet bundle 5 is formed. Further, the "edge part 5*a* of the sheet bundle 5" in the following description means the edge part 5*a* of the sheet bundle 5 in which the plurality of sheets S are shifted in the stepwise shape.

Next, the sheet binding device 3 moves the second roller 42 in a direction away from the first roller 41. Accordingly, the recess of the outer peripheral surface 41*s* of the first roller 41 is eliminated. Next, the sheet binding device 3 moves the sheet bundle 5 toward a reverse direction X2 opposite to the sheet conveying direction X1 by reversely rotating the first roller 41 and the second roller 42. Next, the sheet binding device 3 switches the conveying path from the second conveying direction to the first conveying direction by switching the switching member 34. Then, the sheet binding device 3 moves the sheet bundle 5 toward the tape mounting part 59 by normally rotating the first roller 41 and the second roller 42.

The sheet binding device 3 according to the embodiment sets the mounting gap W2 to be equal to or smaller than the thickness W1 of the sheet bundle 5 (W2 W1, refer to FIG. 4) before the sheet bundle 5 is inserted between the first roller 91 and the second roller 92. The sheet binding device 3 sets the guide gap based upon the thickness W1 of the sheet bundle 5. For example, when the number of sheets S forming the sheet bundle 5 is ten, the guide gap is set based upon the thickness of ten sheets.

For example, the guide side cam 80*a* rotates around the rotating shaft 80*b* of the guide side cam 80*a* by operating the knob (the operation part 83). Accordingly, the mounting side cam 81*a* rotates around the rotating shaft 81*b* of the mounting side cam 81*a* according to the rotation of the guide side cam 80*a*. Thus, the guide gap and the mounting gap are interlocked with each other, thereby being adjusted. For example, when the number of sheets S forming the sheet bundle 5 is ten, the guide gap and the mounting gap are set based upon the thickness of ten sheets.

As illustrated in FIG. 4, the sheet binding device 3 according to the embodiment changes the length L of the tape T to be cut by the cutter 56 based upon the shift amount d between the sheets S changed by the control part 26 (refer to FIG. 1). For example, in the embodiment, the position of the cutter 56 is changed in such a manner that the control part 26 controls the drive source 73 (refer to FIG. 2) of the cutting length changing part 57.

Figure 5:
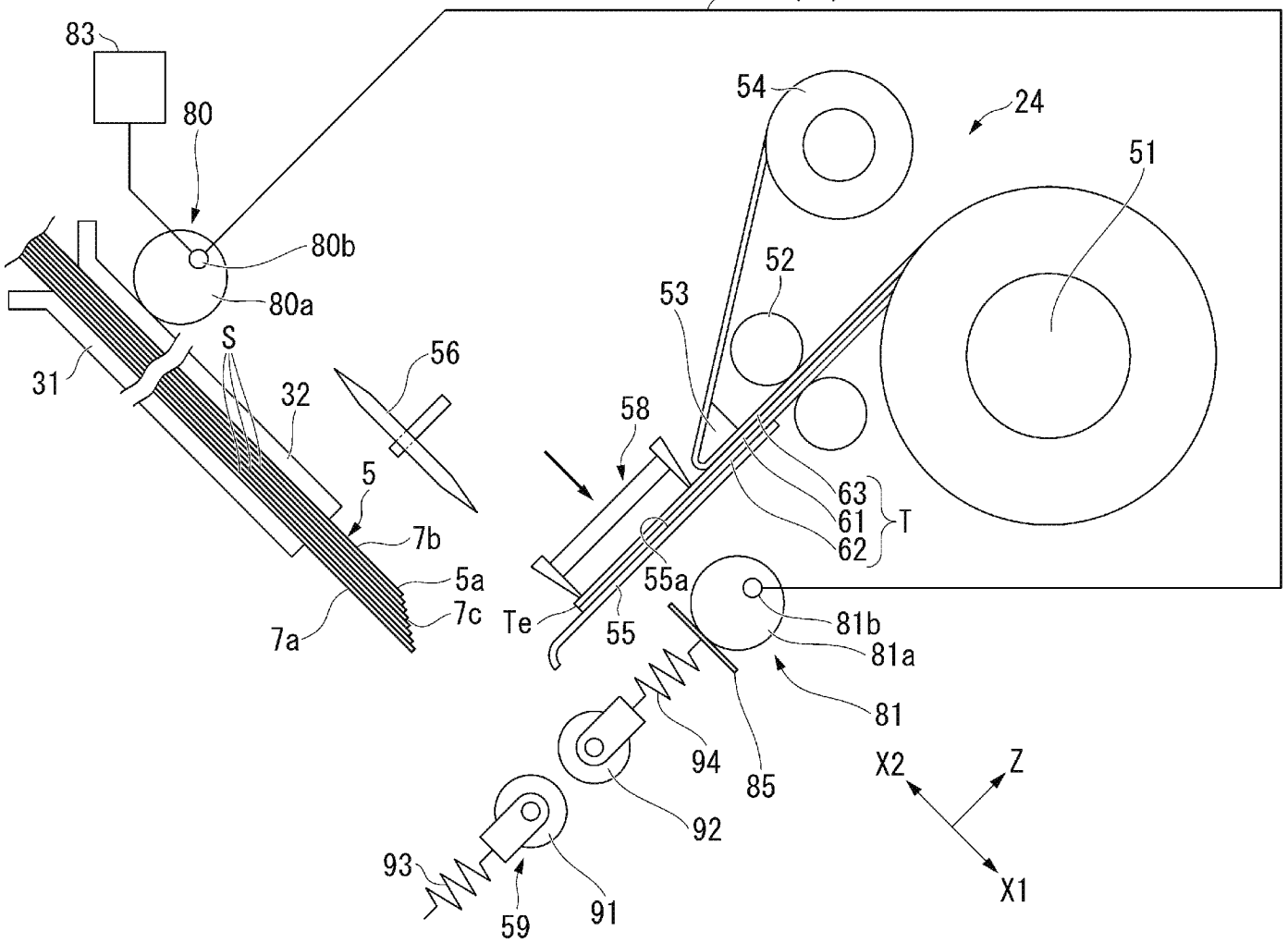
FIG. 5 is a front view illustrating the operation of the sheet binding device, following FIG. 4.

Next, as illustrated in FIG. 5, the sheet binding device 3 supports the tape T in a state where the attitude of the tape T is maintained by allowing the tape holding part 58 to abut on the tape T. In the embodiment, the tape holding part 58 abuts on opposite ends of the guide table 55 (an upstream end and a downstream end in the conveying direction of the tape T), thereby supporting the tape T having an approximately flat shape (a linear shape).

Figure 6:
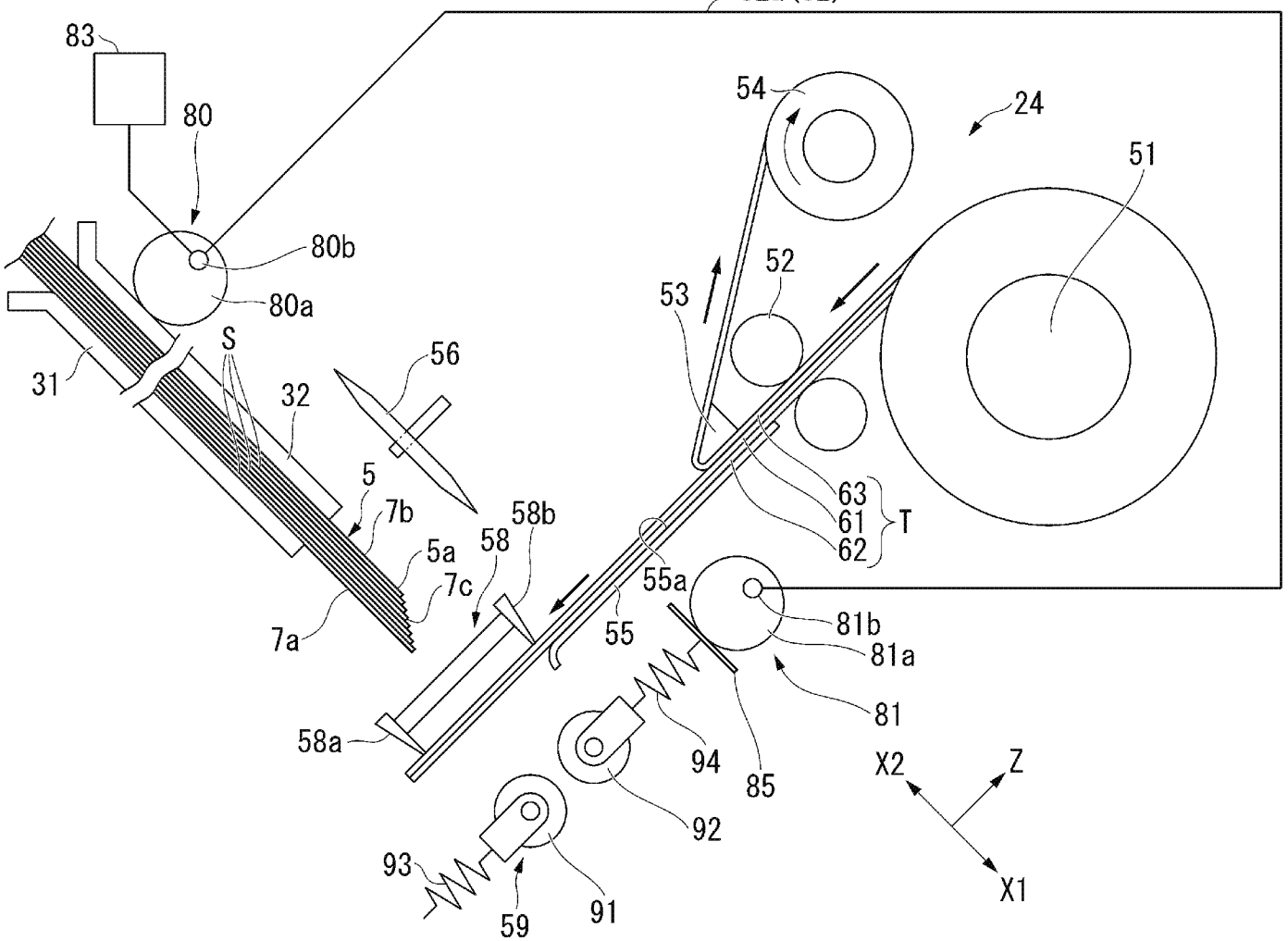
FIG. 6 is a front view illustrating the operation of the sheet binding device, following FIG. 5.

Next, as illustrated in FIG. 6, the sheet binding device 3 moves the tape holding part 58 between the sheet bundle 5 and the tape mounting part 59. For example, the tape holding part 58 disposes the tape T so as to straddle the first roller 91 and the second roller 92. For example, the tape holding part 58 disposes the tape T so that a center part of the linear tape T faces a center between the rollers of the first roller 91 and the second roller 92. In other words, the tape holding part 58 allows the center part between the first tape supporting part 58*a* and the second tape supporting part 58*b* that hold the tape T to face the center between the rollers of the first roller 91 and the second roller 92.

Figure 7:
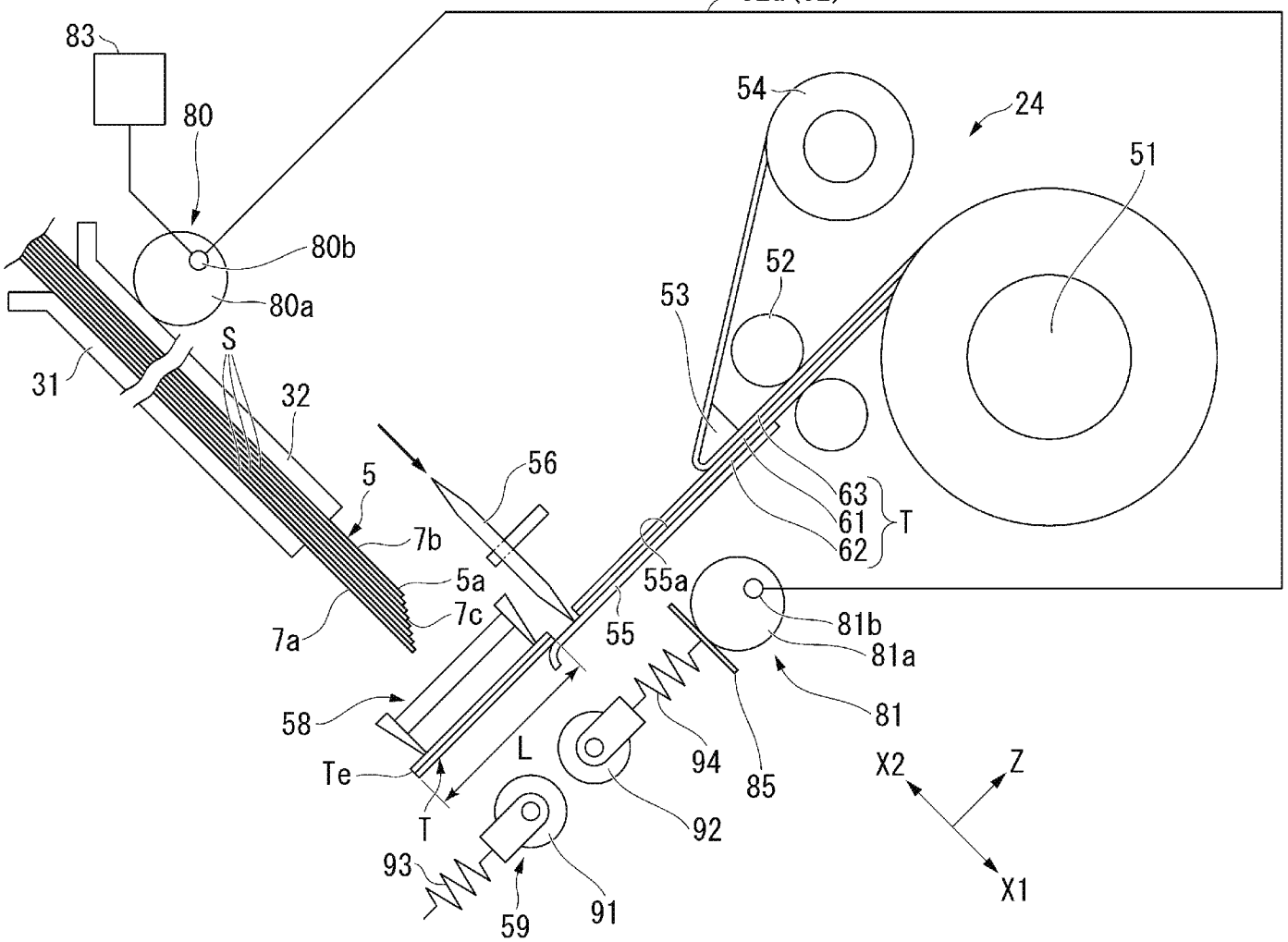
FIG. 7 is a front view illustrating the operation of the sheet binding device, following FIG. 6.

Next, as illustrated in FIG. 7, the sheet binding device 3 cuts a band-shaped tape T by the cutter 56, thereby forming a sheet-like tape T. Accordingly, the tape T is cut in a required length.

Figure 8:
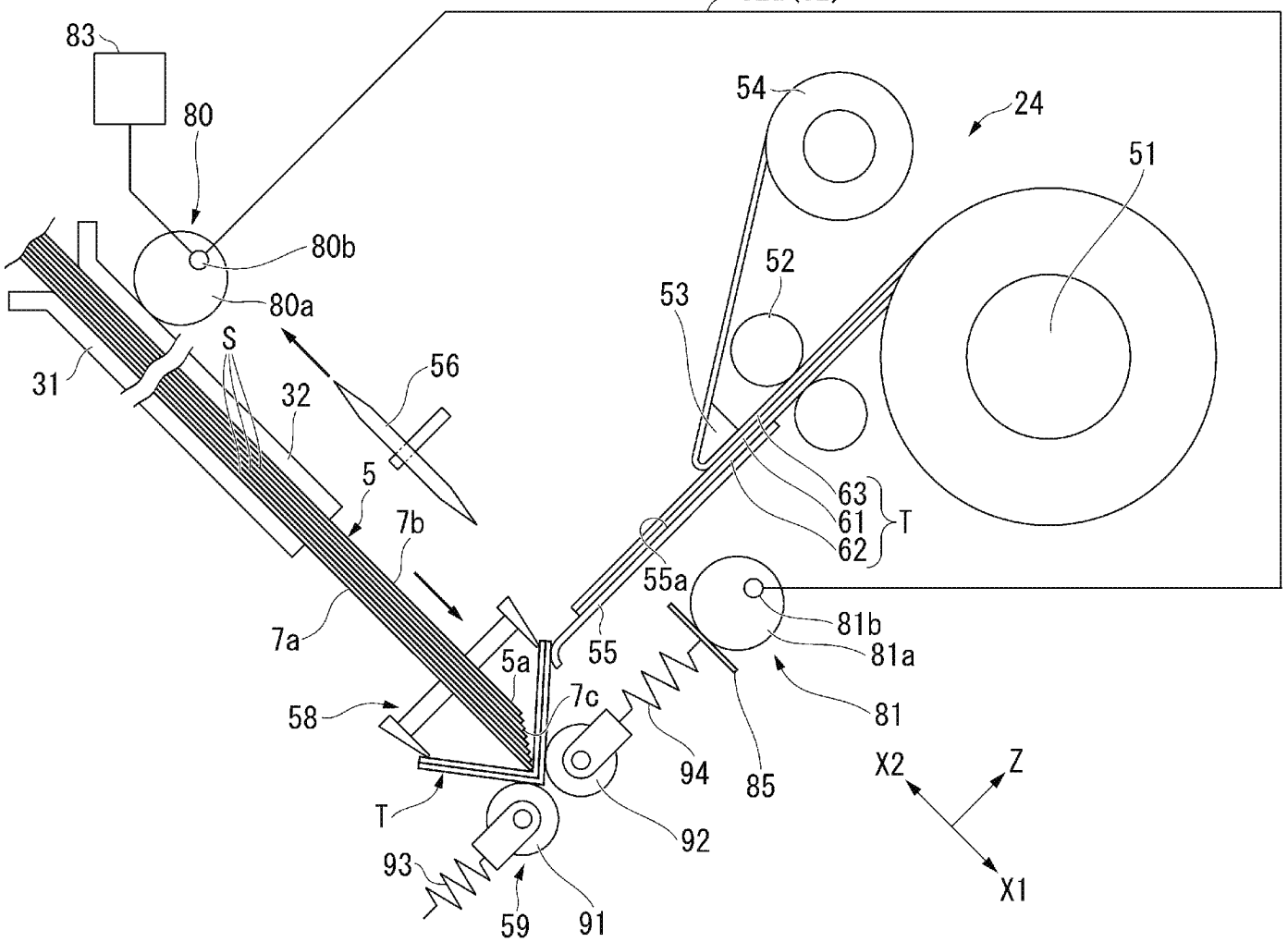
FIG. 8 is a front view illustrating the operation of the sheet binding device, following FIG. 7.

Next, as illustrated in FIG. 8, the sheet binding device 3 moves the sheet bundle 5 toward the tape mounting part 59 by the sheet shifting part 23 (refer to FIG. 2). For example, the sheet binding device 3 moves (inserts) the sheet bundle 5 toward the tape mounting part 59 by normally rotating the first roller 41 and the second roller 42 (refer to FIG. 2). The sheet binding device 3 conveys the sheet bundle 5 that is in a state of being sandwiched between the main guide 31 and the sub guide 32 toward a space between the first roller 91 and the second roller 92. The sheet binding device 3 allows the edge tip of the sheet bundle 5 to face the inside of the width D1 between the center of the first roller 91 and the center of the second roller 92. The sheet binding device 3 peels the tape T from the tape holding part 58 by inserting the sheet bundle 5 into the tape T held by the tape holding part 58. The sheet binding device 3 inserts the edge part 5*a* of the sheet bundle 5 between the first roller 91 and the second roller 92 together with the tape T.

Figure 9:
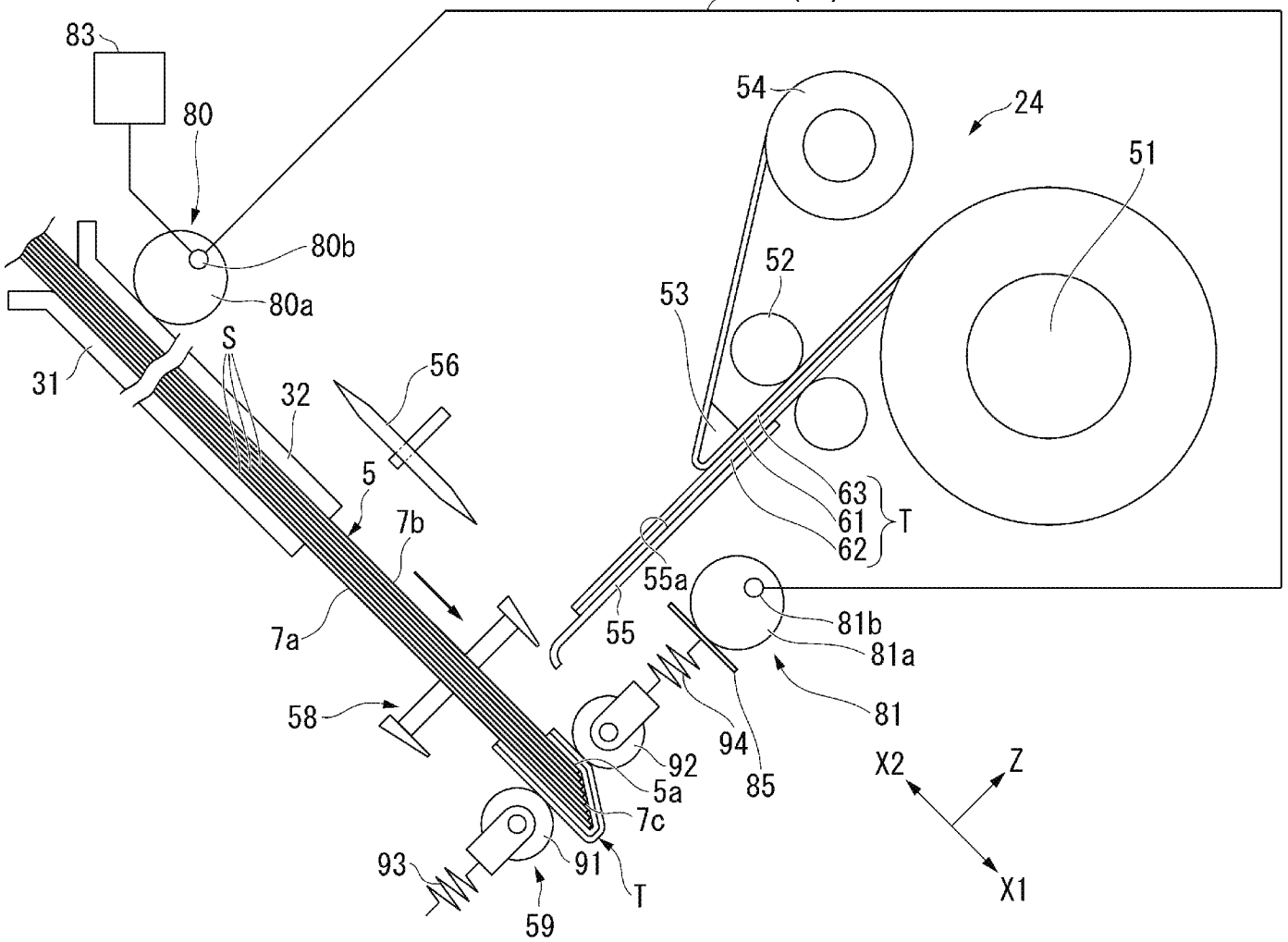
FIG. 9 is a front view illustrating the operation of the sheet binding device, following FIG. 8.

As illustrated in FIG. 9, when the edge part 5*a* of the sheet bundle 5 is inserted between the first roller 91 and the second roller 92 together with the tape T, the first roller 91 and the second roller 92 move along an outer shape of the edge part 5*a* of the sheet bundle 5. Accordingly, the first roller 91 and the second roller 92 press the tape T against the edge part 5*a* of the sheet bundle 5. As a result, the tape T sequentially follows and adheres to a stepwise-shaped portion of the sheet bundle 5. Here, the edge part 5*a* of the sheet bundle 5 includes a first surface 7*a*, a second surface 7*b*, and an end surface 7*c*. The first surface 7*a* and the second surface 7*b* are surfaces disposed along the sheet conveying direction X1. The second surface 7*b* is positioned on a side opposite to the first surface 7*a*. The end surface 7*c* is positioned between the first surface 7*a* and the second surface 7*b*, and the plurality of sheets S are shifted in the stepwise shape. The sheets S are mounted over the first surface 7*a*, the end surface 7*c*, and the second surface 7*b* at the edge part 5*a* of the sheet bundle 5. As a result, all the sheets S including the intermediate page of the sheet bundle 5 are integrated by the tape T. Accordingly, a process of mounting the tape T on the edge part 5*a* of the sheet bundle 5 is completed.

Figure 10:
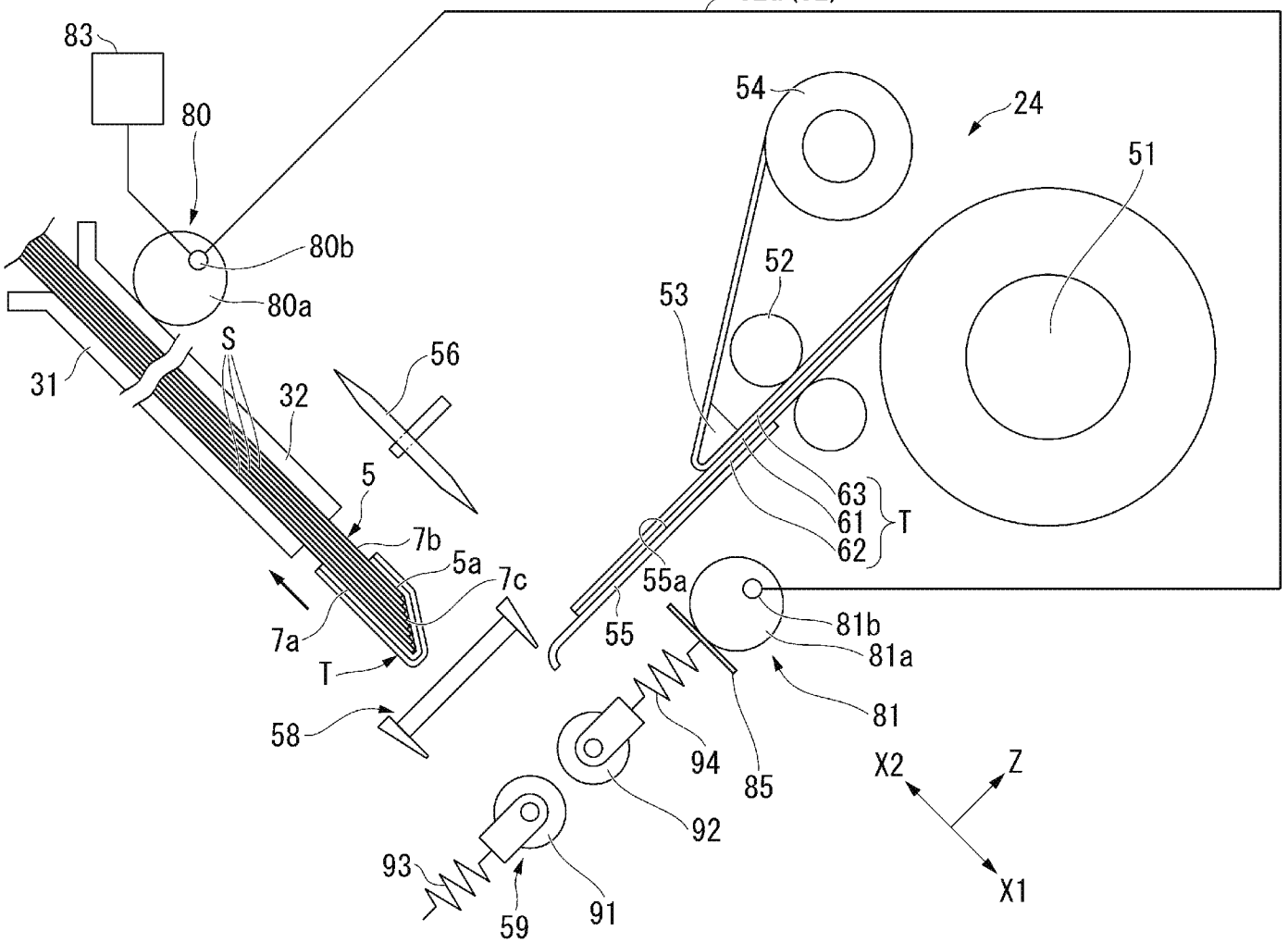
FIG. 10 is a front view illustrating the operation of the sheet binding device, following FIG. 9.

Next, as illustrated in FIG. 10, the sheet binding device 3 reversely rotates the first roller 41 and the second roller 42 (refer to FIG. 2), thereby taking out the sheet bundle 5 from between the first roller 91 and the second roller 92. Then, the sheet binding device 3 further reversely rotates the first roller 41 and the second roller 42 (refer to FIG. 2), thereby discharging the sheet bundle 5 to the discharge part of the sheet binding device 3.

As described above, a series of operations by the sheet binding device 3 is completed.

Next, an operation of a sheet binding device according to a comparative example will be described.

Figure 11:
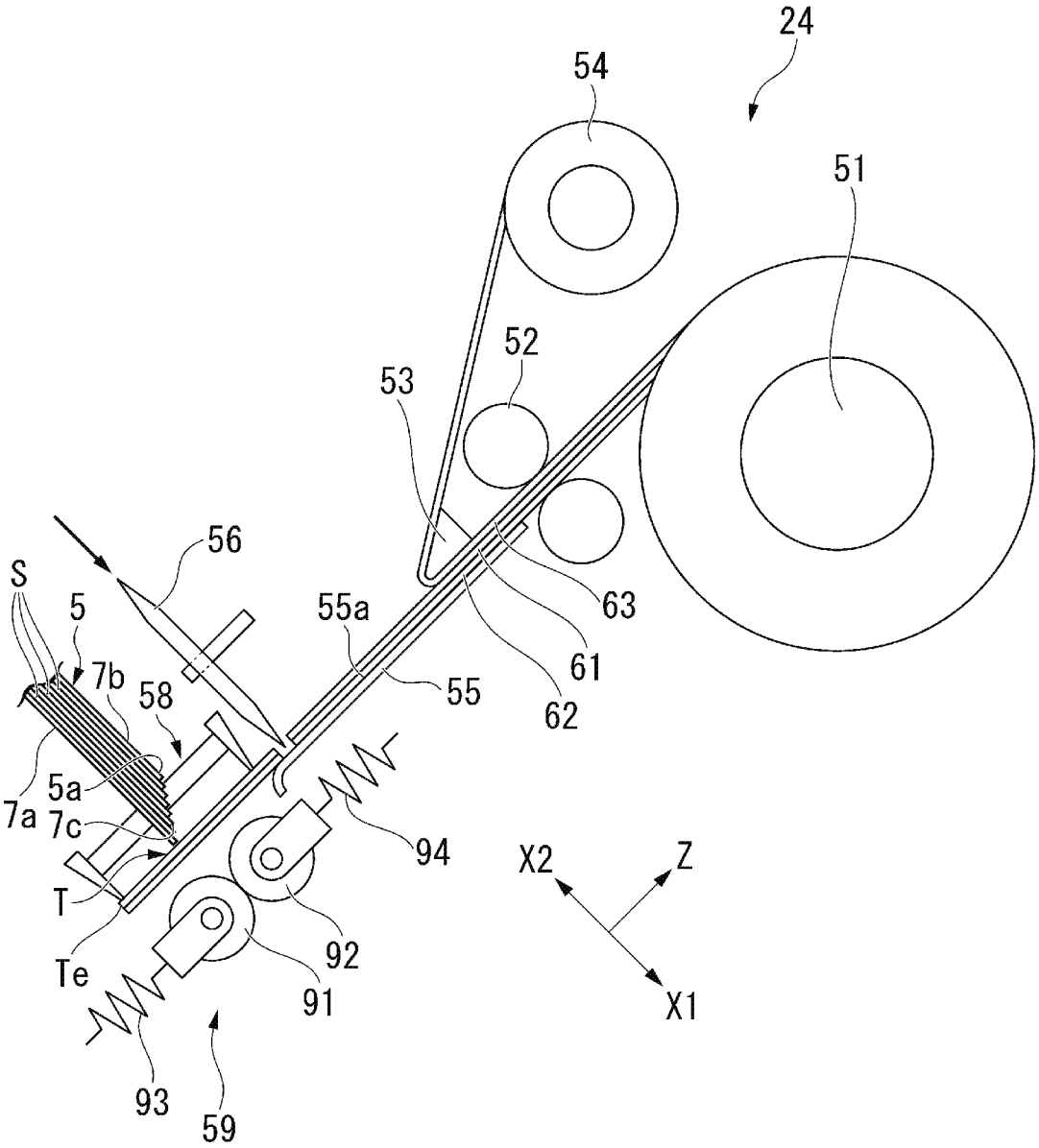
FIG. 11 is a front view illustrating an operation of a sheet binding device according to a comparative example.

FIG. 11 is a front view illustrating the operation of the sheet binding device according to the comparative example.

As illustrated in FIG. 11, the sheet binding device according to the comparative example does not include the mounting adjustment part 81 (refer to FIG. 4).

In the comparative example, the mounting gap is constant (zero in the example of the drawing) regardless of the thickness of the sheet bundle 5 before the sheet bundle 5 is inserted between the first roller 91 and the second roller 92. Therefore, there is a high possibility that the mounting gap is too narrow with respect to the thickness of the sheet bundle 5 such that the sheet bundle 5 cannot enter between the first roller 91 and the second roller 92.

Meanwhile, as illustrated in FIG. 4, in the embodiment, the mounting adjustment part 81 capable of adjusting the mounting gap based upon the thickness of the sheet bundle 5 is provided. Therefore, there is a low possibility that the mounting gap is too narrow with respect to the thickness of the sheet bundle 5 such that the sheet bundle 5 cannot enter between the first roller 91 and the second roller 92.

According to the embodiment, the sheet binding device 3 includes the first mounting part 90A, the second mounting part 90B, and the mounting adjustment part 81. The first mounting part 90A mounts the tape T on the edge part 5*a* of the sheet bundle 5. The second mounting part 90B is opposite to the first mounting part 90A in the sheet bundle thickness direction Z. The mounting adjustment part 81 can adjust the mounting gap between the first mounting part 90A and the second mounting part 90B based upon the thickness of the sheet bundle 5. The mounting gap W2 is equal to or smaller than the thickness W1 of the sheet bundle 5 before the sheet bundle 5 is inserted between the first mounting part 90A and the second mounting part 90B. An effect described hereinbelow is achieved by the above-mentioned configuration.

The mounting gap can be adjusted based upon the thickness of the sheet bundle 5 by the mounting adjustment part 81. In comparison with a case in which the mounting gap is constant regardless of the thickness of the sheet bundle 5, there is the low possibility that the mounting gap is too narrow with respect to the thickness of the sheet bundle 5 such that the sheet bundle 5 cannot enter between the first roller 91 and the second roller 92. Additionally, there is a low possibility that the mounting gap is too wide with respect to the thickness of the sheet bundle 5 such that the tape T cannot sufficiently adhere to the edge part 5*a* of the sheet bundle 5. Accordingly, it is possible to bind the sheet bundle 5 regardless of the thickness of the sheet bundle 5. Further, before the sheet bundle 5 is inserted between the first mounting part 90A and the second mounting part 90B, the tape T easily follows the edge part 5*a* of the sheet bundle 5 in comparison with a case in which the mounting gap is greater than the thickness of the sheet bundle 5. Therefore, it is possible to more surely bind the sheet bundle 5.

The sheet binding device 3 is further provided with the main guide 31 that guides the sheet bundle 5 toward a space between the first mounting part 90A and the second mounting part 90B, the sub guide 32 opposite to the main guide 31 in the sheet bundle thickness direction Z, the inter-guide adjustment part 80 capable of adjusting the guide gap between the main guide 31 and the sub guide 32, and the interlocking mechanism 82 that allows the inter-guide adjustment part 80 and the mounting adjustment part 81 to be interlocked with each other. An effect described hereinbelow is achieved by the above-mentioned configuration.

Since the sheet bundle 5 can be sandwiched by the main guide 31 and the sub guide 32, curling of the sheet bundle 5 can be suppressed. Accordingly, the sheet bundle 5 is stably and easily guided in comparison with a case in which only one guide is provided. Further, the guide gap and the mounting gap can be adjusted by being interlocked with each other. The device configuration is simplified, thereby contributing to cost reduction in comparison with a case in which the guide gap and the mounting gap are respectively adjusted by using two motors. Additionally, complicated control is not required in this configuration, thereby contributing to energy saving.

The guide gap is set based upon the thickness of the sheet bundle 5. An effect described hereinbelow is achieved by the above-mentioned configuration.

It is possible to hold the attitude of the sheet bundle 5 regardless of the thickness of the sheet bundle 5.

The mounting adjustment part 81 can adjust the mounting gap. The interlocking mechanism 82 allows the inter-guide adjustment part 80 and the mounting adjustment part 81 to be interlocked with each other so that the mounting gap becomes gradually narrower as the guide gap becomes narrower. The interlocking mechanism 82 allows the inter-guide adjustment part 80 and the mounting adjustment part 81 to be interlocked with each other so that the mounting gap becomes gradually wider as the guide gap becomes wider. An effect described hereinbelow is achieved by the above-mentioned configuration.

The guide gap and the mounting gap can be adjusted in the stepwise shape by being interlocked with each other. Accordingly, the tape T easily follows the edge part 5*a* of the sheet bundle 5 in comparison with a case in which the guide gap and the mounting gap are adjusted with only one stage.

The sheet binding device 3 is further provided with the bundle conveying part 40 that conveys the sheet bundle 5 in a state of being sandwiched between the main guide 31 and the sub guide 32 toward the space between the first mounting part 90A and the second mounting part 90B. An effect described hereinbelow is achieved by the above-mentioned configuration.

It is possible to convey the sheet bundle 5 toward the space between the first mounting part 90A and the second mounting part 90B in a state where the attitude of the sheet bundle 5 is held. Accordingly, the tape T can be mounted on the edge part of the sheet bundle 5 while suppressing the curling of the sheet bundle 5.

The mounting adjustment part 81 is provided with the eccentric cam 81*a* capable of adjusting the mounting gap. An effect described hereinbelow is achieved by the above-mentioned configuration.

The mounting gap can be adjusted with a simple configuration provided with the eccentric cam 81*a*. Further, complicated control is not required in comparison with a case in which a motor is provided, thereby contributing to energy saving.

The inter-guide adjustment part 80 is provided with the guide side cam 80*a* that allows the sub guide 32 to be close to or to be away from the main guide 31. The mounting adjustment part 81 is provided with the mounting side cam 81*a* that allows the second mounting part 90B to be close to or to be away from the first mounting part 90A. The interlocking mechanism 82 is provided with the power transmission mechanism 82*a* that transmits the rotational force of the guide side cam 80*a* to the mounting side cam 81*a*. An effect described hereinbelow is achieved by the above-mentioned configuration.

The guide gap and the mounting gap can be adjusted by being interlocked with each other with a simple configuration provided with the guide side cam 80*a*, the mounting side cam 81*a*, and the power transmission mechanism 82*a*. This device configuration is simplified, thereby contributing to cost reduction in comparison with a case in which the guide gap and the mounting gap are respectively adjusted by using two motors. Additionally, complicated control is not required, thereby contributing to energy saving.

Each of the guide side cam 80*a* and the mounting side cam 81*a* is positioned in one side (the second region A2) of the two regions A1 and A2 that are partitioned by the sheet bundle 5 in the sheet bundle thickness direction Z. An effect described hereinbelow is achieved by the above-mentioned configuration.

A power transmission path between the guide side cam 80*a* and the mounting side cam 81*a* can be shortened in comparison with a case in which the guide side cam 80*a* and the mounting side cam 81*a* are positioned in mutually different regions in the sheet bundle thickness direction Z, resulting in contributing to miniaturization of the power transmission mechanism 82*a*.

The sheet binding device 3 is further provided with the operation part 83 for rotating the guide side cam 80*a* around the rotating shaft 80*b* of the guide side cam 80*a*. An effect described hereinbelow is achieved by the above-mentioned configuration.

The guide side cam 80*a* rotates around the rotating shaft 80*b* of the guide side cam 80*a* by the operation of the operation part 83. Accordingly, the mounting side cam 81*a* rotates around the rotating shaft 81*b* of the mounting side cam 81*a* according to the rotation of the guide side cam 80*a*. Accordingly, the guide gap and the mounting gap are adjusted by being interlocked with each other. As a result, the guide gap and the mounting gap can be adjusted by being interlocked with each other with a simple configuration provided with the operation part 83.

The first mounting part 90A is provided with the first roller 91 and the first spring 93 for urging the first roller 91 toward the second mounting part 90B. The second mounting part 90B is provided with the second roller 92 opposite to the first roller 91 in the sheet bundle thickness direction Z, and the second spring 94 for urging the second roller 92 toward the first roller 91. The main guide 31 guides the sheet bundle 5 so that the edge tip of the sheet bundle 5 faces the inside of the width D1 between the center of the first roller 91 and the center of the second roller 92. An effect described hereinbelow is achieved by the above-mentioned configuration.

Since the tape T can follow the edge part 5*a* of the sheet bundle 5, it is possible to more surely bind the sheet bundle 5. Further, in comparison with a case in which the sheet bundle 5 is guided so that the edge tip of the sheet bundle 5 faces the outside of the width D1 between the center of the first roller 91 and the center of the second roller 92, the sheet bundle 5 easily enters between the first roller 91 and the second roller 92.

Next, a first modification of the first embodiment will be described.

The mounting side cam 81*a* is not limited to having substantially the same outer shape as that of the guide side cam 80*a*. The adjustment amount of the mounting adjustment part 81 (the adjustment amount of the mounting gap) is not limited to being substantially the same as the adjustment amount of the inter-guide adjustment part 80 (the adjustment amount of the guide gap).

Figure 12:
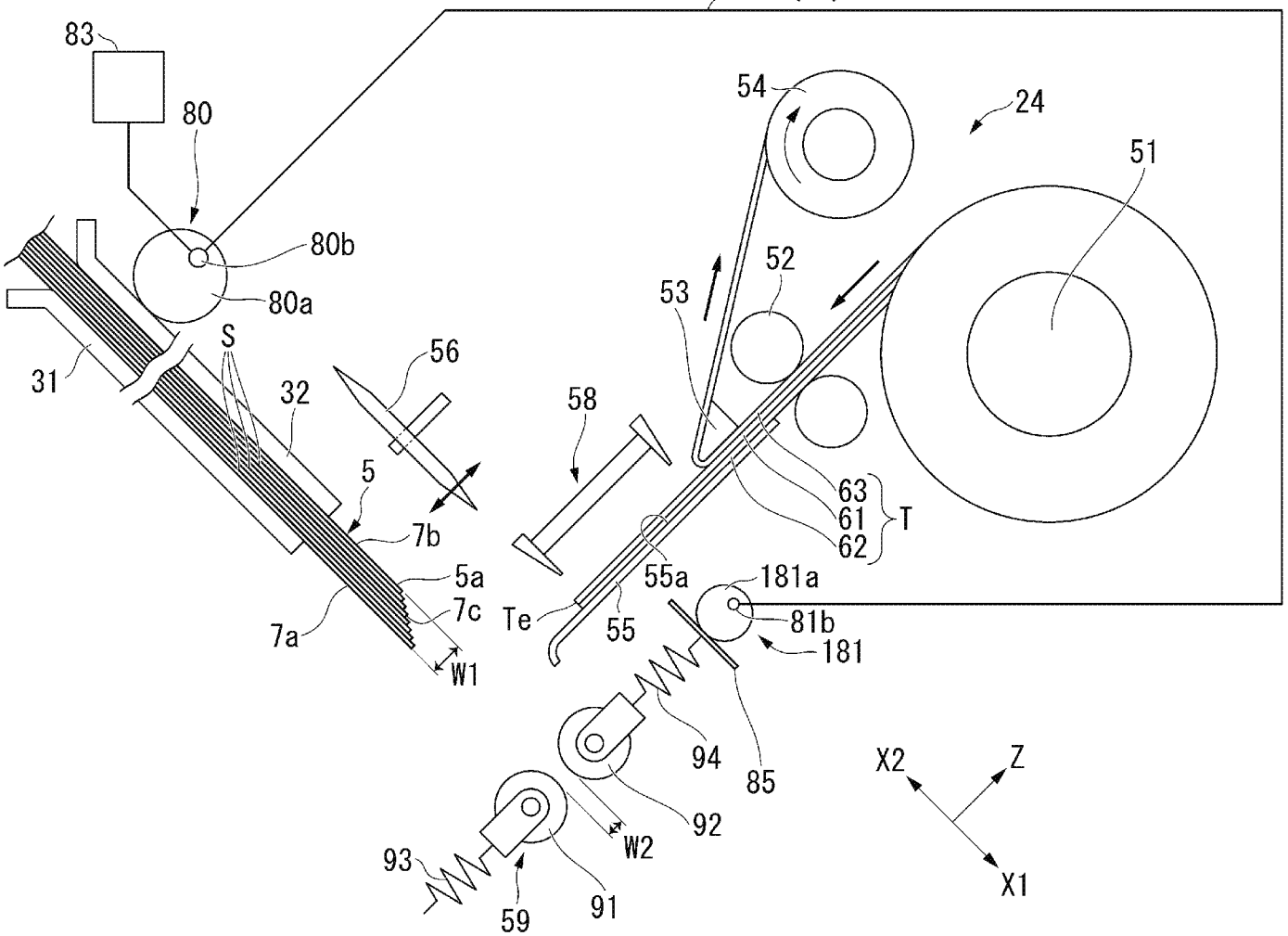
FIG. 12 is a front view illustrating an internal configuration of a sheet binding device according to a first modification of the first embodiment.

FIG. 12 is a front view illustrating a sheet binding device according to the first modification of the first embodiment. As illustrated in FIG. 12, a mounting side cam 181*a* may have an outer shape smaller than that of the guide side cam 80*a*. In the modification, an adjustment amount of a mounting adjustment part 181 (an adjustment amount of a mounting gap) is smaller than the adjustment amount of the inter-guide adjustment part 80 (the adjustment amount of the guide gap). For example, when the adjustment amount of the inter-guide adjustment part 80 is set to 1, the adjustment amount of the mounting adjustment part 181 is set to 0.5. For example, when the guide gap is opened by 1 mm, the mounting gap is opened by 0.5 mm.

According to the first modification of the first embodiment, the adjustment amount of the mounting adjustment part 181 is smaller than the adjustment amount of the inter-guide adjustment part 80. An effect described hereinbelow is achieved by the above-mentioned configuration.

A pressing force (an urging force of an urging member) is easily applied to the sheet bundle 5 in comparison with a case in which the adjustment amount of the mounting adjustment part 181 is the same as the adjustment amount of the inter-guide adjustment part 80. Therefore, the tape T easily follows the edge part 5*a* of the sheet bundle 5.

Next, a second modification of the first embodiment will be described.

The mounting gap is not limited to being greater than zero and smaller than the thickness of the sheet bundle 5 before the sheet bundle 5 is inserted between the first roller 91 and the second roller 92.

Figure 13:
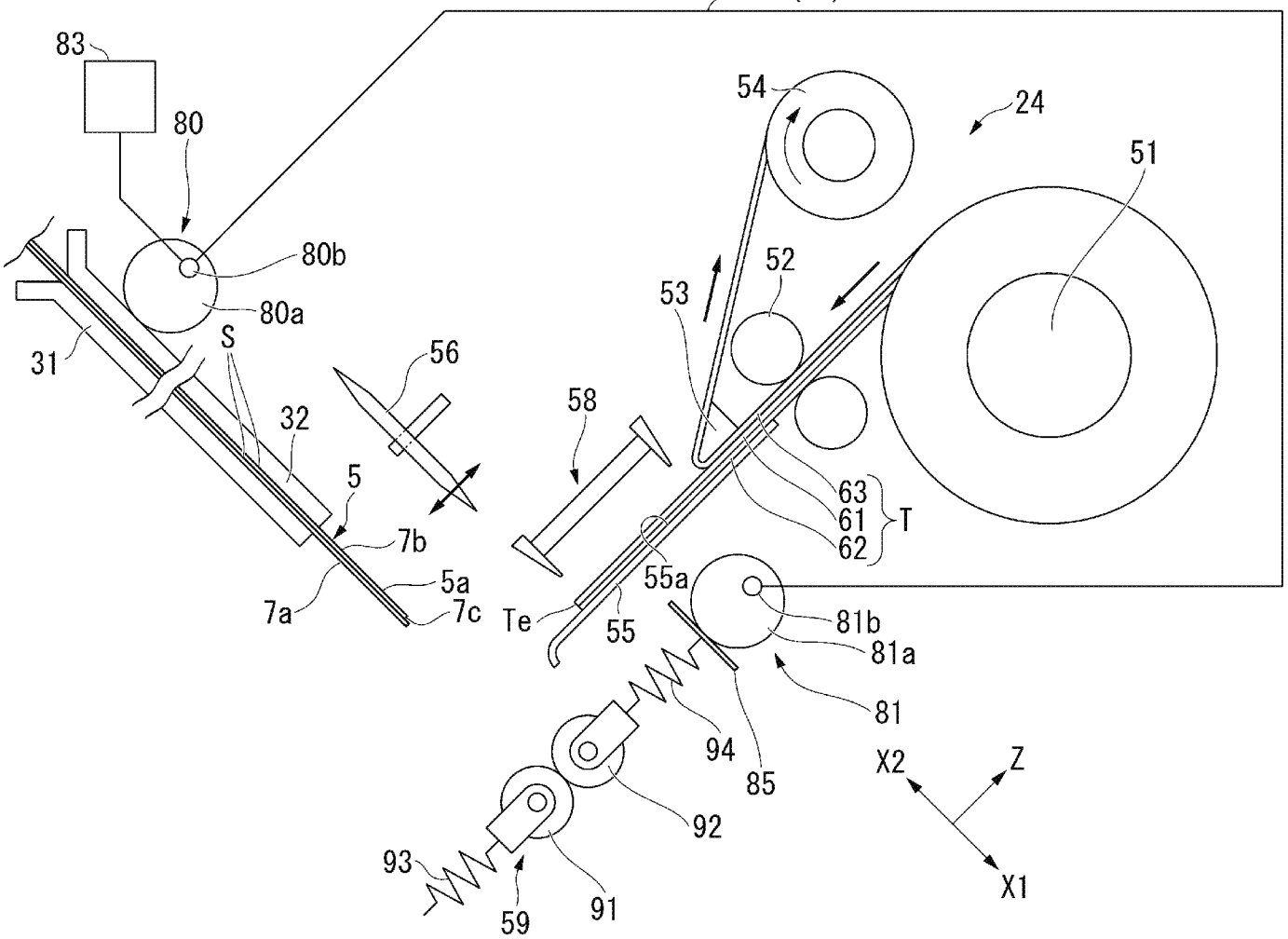
FIG. 13 is a front view illustrating an internal configuration of a sheet binding device according to a second modification of the first embodiment.

FIG. 13 is a front view illustrating a sheet binding device according to the second modification of the first embodiment. As illustrated in FIG. 13, the mounting gap may be zero before the sheet bundle 5 is inserted between the first roller 91 and the second roller 92. In the example illustrated in the drawing, the number of sheets S forming the sheet bundle 5 is two. For example, when the number of sheets S forming the sheet bundle 5 is two, the guide gap is set based upon the thickness of two sheets. For example, the mounting gap is held at zero (constant) before the sheet bundle 5 is inserted between the first roller 91 and the second roller 92.

According to the second modification of the first embodiment, the mounting gap is zero before the sheet bundle 5 is inserted between the first roller 91 and the second roller 92. An effect described hereinbelow is achieved by the above-mentioned configuration.

When the number of sheets S forming the sheet bundle 5 is two, the tape T can follow the edge part 5*a* of the sheet bundle 5. Accordingly, it is possible to more surely bind the sheet bundle 5 (two sheets).

Next, a second embodiment will be described. In the second embodiment, a description of the same configuration as that of the first embodiment will be omitted.

The first mounting part 90A is not limited to being provided with the first spring 93 (the first urging member) that urges the first roller 91 toward the second mounting part 90B. The second embodiment is different from the first embodiment in that the first mounting part 90A does not include the first spring 93. In other words, in the second embodiment, the second mounting part 90B of the first mounting part 90A and the second mounting part 90B includes the urging member.

Figure 14:
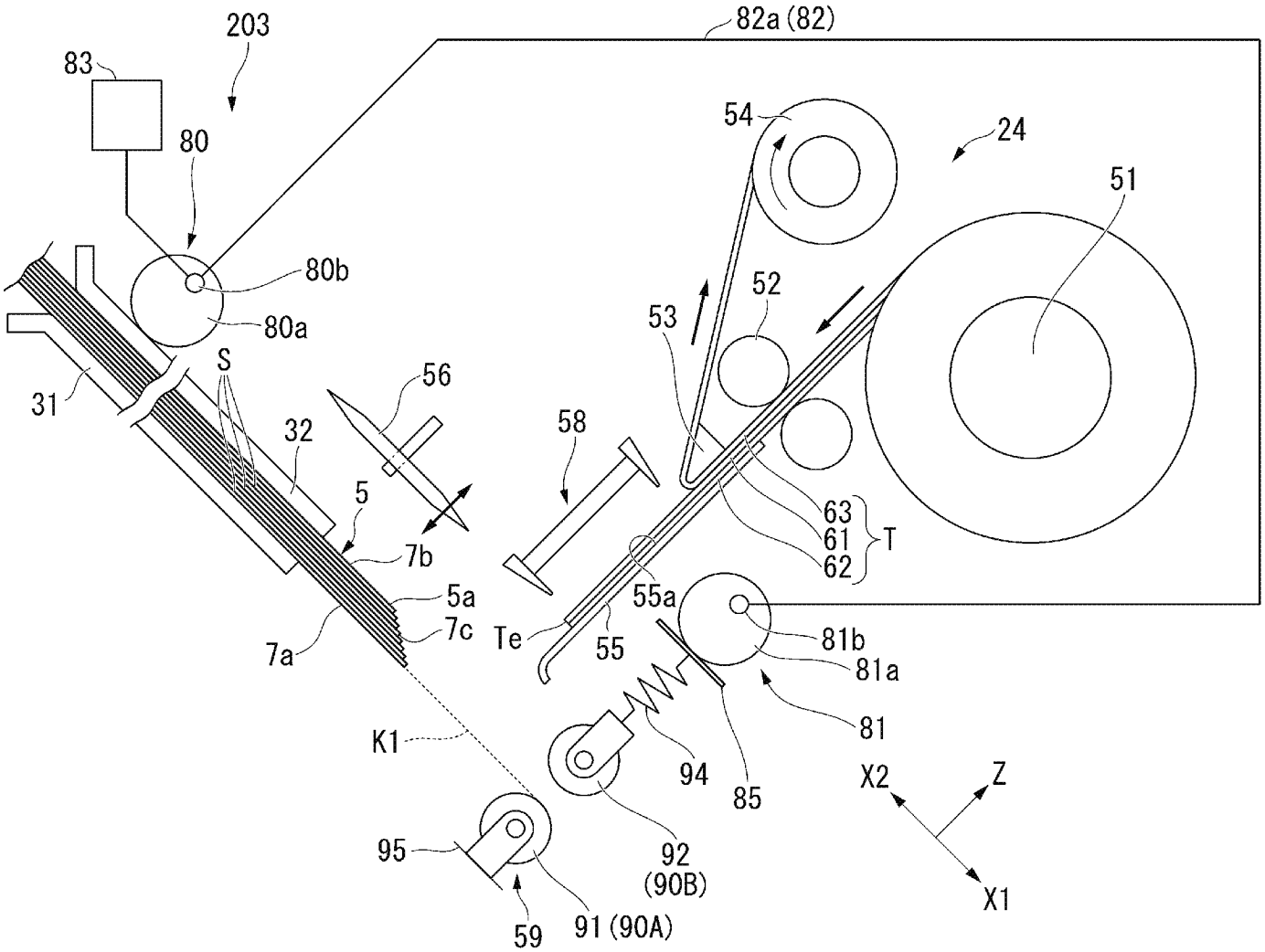
FIG. 14 is a front view illustrating an internal configuration of a sheet binding device according to a second embodiment.

FIG. 14 is a front view illustrating a sheet binding device 203 according to the second embodiment.

As illustrated in FIG. 14, the first mounting part 90A is provided with a supporting member 95 for rotatably supporting the first roller 91. The supporting member 95 supports the first roller 91 at a fixed position.

The main guide 31 guides the sheet bundle 5 so that the edge tip of the sheet bundle 5 faces a nip forming end of the first roller 91. Here, the nip forming end of the first roller 91 means a portion of the outer peripheral surface of the first roller 91 that forms a nip by cooperating with the second roller 92. The nip forming end of the first roller 91 corresponds to an end edge of the first roller 91 closest to the second roller 92 in the sheet bundle thickness direction Z. A reference sign K1 in the drawing indicates a virtual straight line that goes along the main guide 31, and passes through the edge tip of the sheet bundle 5 and the nip forming end of the first roller 91.

According to the second embodiment, the first mounting part 90A is provided with the first roller 91, and the supporting member 95 that rotatably supports the first roller 91. The second mounting part 90B is provided with the second roller 92 opposite to the first roller 91 in the sheet bundle thickness direction Z, and the second spring 94 that urges the second roller 92 toward the first roller 91. The main guide 31 guides the sheet bundle 5 so that the edge tip of the sheet bundle 5 faces the nip forming end of the first roller 91. An effect described hereinbelow is achieved by the above-mentioned configuration.

Since the tape T can follow the edge part 5*a* of the sheet bundle 5 by the urging member (the second spring 94) of the second mounting part 90B, it is possible to more surely bind the sheet bundle 5. Further, the sheet bundle 5 easily enters between the first roller 91 and the second roller 92 in comparison with a case in which the sheet bundle 5 is guided to a position where the edge tip of the sheet bundle 5 is shifted from the nip forming end of the first roller 91.

Next, a third embodiment will be described. In the third embodiment, a description of the same configuration as that of the first embodiment will be omitted.

The sheet binding device is not limited to being provided with the interlocking mechanism 82 that allows the inter-guide adjustment part 80 and the mounting adjustment part 81 to be interlocked with each other. The third embodiment is different from the first embodiment in that the sheet binding device does not include the interlocking mechanism 82.

Figure 15:
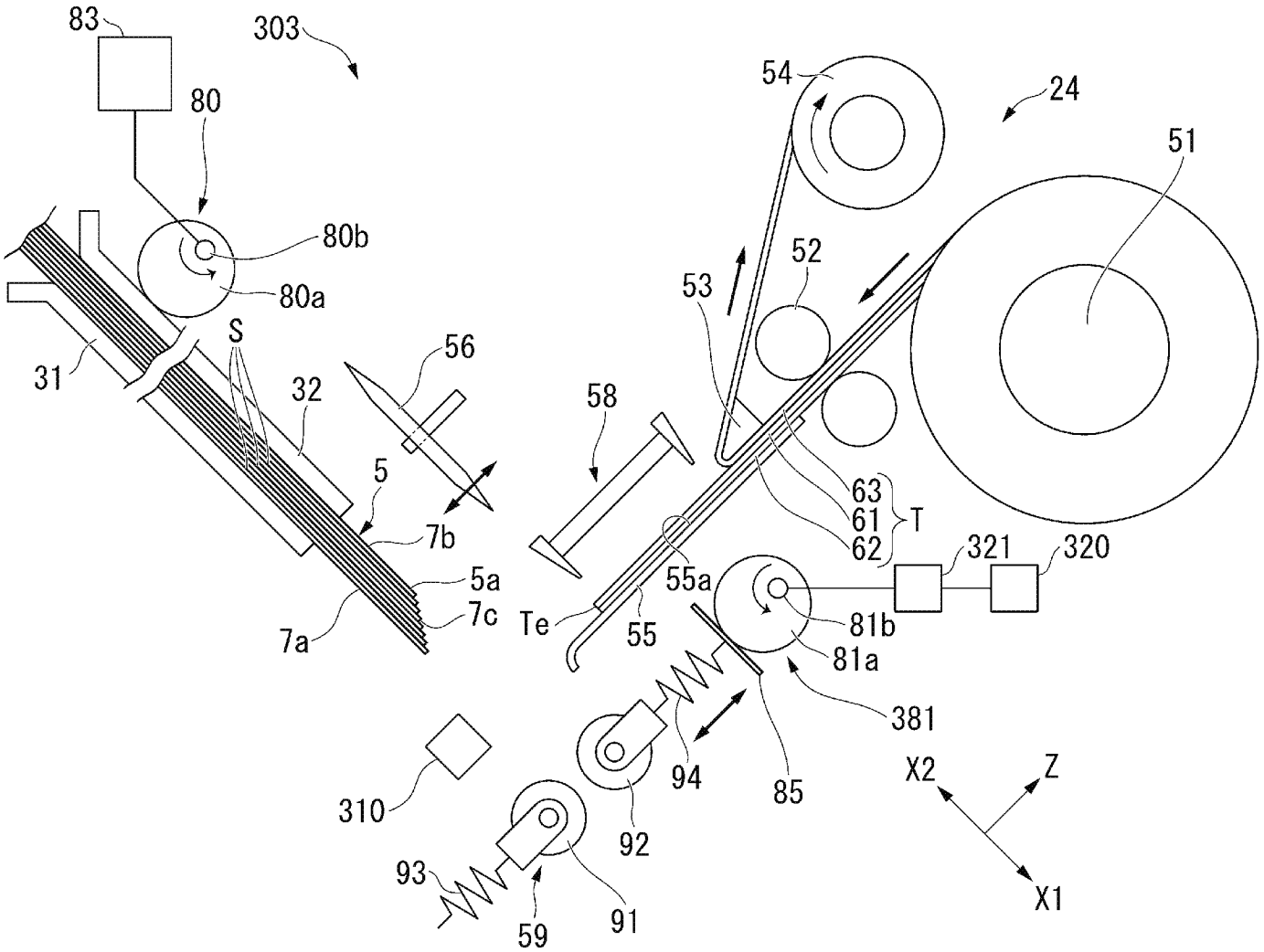
FIG. 15 is a front view illustrating an internal configuration of a sheet binding device according to a third embodiment.

FIG. 15 is a front view illustrating a sheet binding device 303 according to the third embodiment.

As illustrated in FIG. 15, the sheet binding device 303 is provided with a mounting adjustment part 381 capable of adjusting the mounting gap. The mounting adjustment part 381 may be provided with a sensor 310 that detects the thickness of the sheet bundle 5, and a control part 320 (hereinafter referred to as a "mounting control part 320") that controls the mounting gap based upon a detection result of the sensor 310.

For example, the sensor 310 is a non-contact type displacement sensor such as a laser type displacement sensor. The sensor 310 is positioned between the main guide 31 and the first roller 91 in the inserting direction of the sheet bundle 5. The sensor 310 is positioned between the tape holding part 58 and the tape mounting part 59 in a state where the tape T is disposed so that the tape holding part 58 straddles the first roller 91 and the second roller 92.

A reference sign 321 in the drawing is a cam drive source for rotating the mounting side cam 81*a*. For example, the cam drive source 321 is a motor.

The mounting control part 320 controls the cam drive source 321 based upon the detection result of the sensor 310. The mounting control part 320 adjusts the mounting gap based upon the thickness of the sheet bundle 5 by controlling the cam drive source 321.

According to the third embodiment, the mounting adjustment part 381 is provided with the sensor 310 that detects the thickness of the sheet bundle 5, and the mounting control part 320 that controls the mounting gap based upon the detection result of the sensor 310. An effect described hereinbelow is achieved by the above-mentioned configuration.

The mounting gap can be adjusted based upon the thickness of the sheet bundle 5 by the mounting control part 320. In comparison with a case in which the mounting gap is constant regardless of the thickness of the sheet bundle 5, there is the low possibility that the mounting gap is too narrow with respect to the thickness of the sheet bundle 5 such that the sheet bundle 5 cannot enter between the first roller 91 and the second roller 92. Further, there is the low possibility that the mounting gap is too wide with respect to the thickness of the sheet bundle 5 such that the tape T cannot sufficiently adhere to the edge part 5*a* of the sheet bundle 5. Accordingly, it is possible to automatically bind the sheet bundle 5 regardless of the thickness of the sheet bundle 5.

Next, a first modification of the third embodiment will be described.

The mounting adjustment part is not limited to being provided with the mounting side cam 81*a* that allows the second mounting part 90B to be close to or to be away from the first mounting part 90A.

Figure 16:
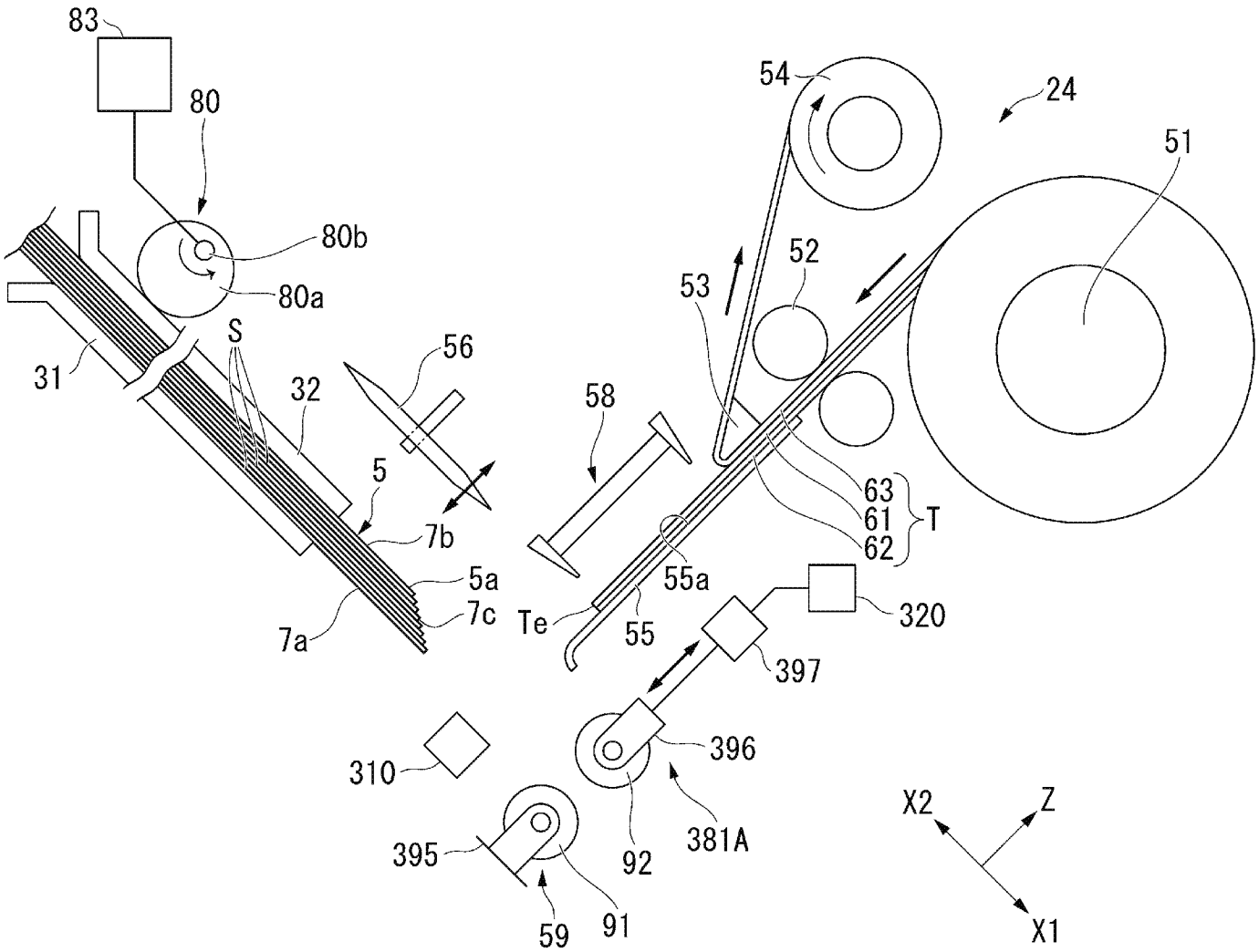
FIG. 16 is a front view illustrating an internal configuration of a sheet binding device according to a first modification of the third embodiment.

FIG. 16 is a front view illustrating a sheet binding device according to the first modification of the third embodiment. As illustrated in FIG. 16, a mounting adjustment part 381A may not be provided with the mounting side cam 81*a*. In the drawing, a reference sign 395 indicates a first supporting member that rotatably supports the first roller 91; a reference sign 396 indicates a second supporting member that rotatably supports the second roller 92; and a reference sign 397 indicates a roller drive source that allows the second roller 92 to be close to or to be away from the first roller 91. For example, the roller drive source 397 is provided with a piston crank mechanism. The mounting control part 320 adjusts the mounting gap based upon the thickness of the sheet bundle 5 by controlling the roller drive source 397.

According to the first modification of the third embodiment, the mounting adjustment part 381A does not include the mounting side cam 81*a*. An effect described hereinbelow is achieved by the above-mentioned configuration.

In comparison with a case in which the mounting adjustment part includes the mounting side cam 81*a*, the number of parts is reduced, thereby contributing to cost reduction.

Hereinafter, another modification of the embodiment will be described.

The mounting gap W2 is not limited to being greater than zero and smaller than the thickness W1 of the sheet bundle 5 before the sheet bundle 5 is inserted between the first roller 91 and the second roller 92. For example, the mounting gap W2 may be the same as the thickness W1 of the sheet bundle 5 (W2=W1) before the sheet bundle 5 is inserted between the first roller 91 and the second roller 92. That is, the mounting gap W2 may be equal to or smaller than the thickness W1 of the sheet bundle 5 (W2≤W1) before the sheet bundle 5 is inserted between the first roller 91 and the second roller 92.

The interlocking mechanism 82 is not limited to allowing the inter-guide adjustment part 80 and the mounting adjustment part 81 to be interlocked with each other so that the mounting gap becomes gradually narrower as the guide gap becomes narrower. For example, the interlocking mechanism 82 may allow the inter-guide adjustment part 80 and the mounting adjustment part 81 to be interlocked with each other so that the mounting gap becomes narrower than an inter-mounting threshold value when the guide gap becomes smaller than an inter-guide threshold value.

The interlocking mechanism 82 is not limited to allowing the inter-guide adjustment part 80 and the mounting adjustment part 81 to be interlocked with each other so that the mounting gap becomes gradually wider as the guide gap becomes wider. For example, the interlocking mechanism 82 may allow the inter-guide adjustment part 80 and the mounting adjustment part 81 to be interlocked with each other so that the mounting gap becomes wider than the inter-mounting threshold value when the guide gap becomes wider than the inter-guide threshold value.

The sheet binding device is not limited to being provided with the main guide 31 that is provided between the first mounting part 90A and the second mounting part 90B, and guides the sheet bundle 5, and the sub guide 32 that is opposite to the main guide 31 in the sheet bundle thickness direction Z. For example, the sheet binding device may not include the sub guide 32. For example, the sheet binding device may be provided with the main guide 31.

According to at least one embodiment described hereinabove, the sheet binding device 3 includes the first mounting part 90A, the second mounting part 90B, and the mounting adjustment part 81. The first mounting part 90A mounts the tape T on the edge part 5*a* of the sheet bundle 5. The second mounting part 90B is opposite to the first mounting part 90A in the sheet bundle thickness direction Z. The mounting adjustment part 81 is capable of adjusting the mounting gap W2 between the first mounting part 90A and the second mounting part 90B based upon the thickness of the sheet bundle 5. The mounting gap W2 is equal to or smaller than the thickness W1 of the sheet bundle 5 before the sheet bundle 5 is inserted between the first mounting part 90A and the second mounting part 90B. The effects described hereinbelow are achieved by the above-mentioned configuration.

The mounting gap can be adjusted based upon the thickness of the sheet bundle 5 by the mounting adjustment part 81. In comparison with a case in which the mounting gap is constant regardless of the thickness of the sheet bundle 5, there is the low possibility that the mounting gap is too narrow with respect to the thickness of the sheet bundle 5 such that the sheet bundle 5 cannot enter between the first roller 91 and the second roller 92. Additionally, there is the low possibility that the mounting gap is too wide with respect to the thickness of the sheet bundle 5 such that the tape T cannot sufficiently adhere to the edge part 5*a* of the sheet bundle 5. Accordingly, it is possible to bind the sheet bundle 5 regardless of the thickness of the sheet bundle 5. Further, before the sheet bundle 5 is inserted between the first mounting part 90A and the second mounting part 90B, the tape T easily follows the edge part 5*a* of the sheet bundle 5 in comparison with a case in which the mounting gap is greater than the thickness of the sheet bundle 5. Therefore, it is possible to more surely bind the sheet bundle 5.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A sheet binding device, comprising:

a first mounting part configured to mount a tape on an edge part of a sheet bundle;

a second mounting part opposite to the first mounting part in a sheet bundle thickness direction; and a mounting adjustment part configured to adjust a mounting gap between the first mounting part and the second mounting part based upon a thickness of the sheet bundle, wherein the mounting gap is equal to or smaller than the thickness of the sheet bundle before the sheet bundle is inserted between the first mounting part and the second mounting part.

2. The device according to claim 1, further comprising:

a first guide configured to guide the sheet bundle toward the mounting gap between the first mounting part and the second mounting part;

a second guide opposite to the first guide in the sheet bundle thickness direction;

an inter-guide adjustment part configured to adjust a guide gap between the first guide and the second guide; and an interlocking mechanism configured to lock or unlock the inter-guide adjustment part with or from the mounting adjustment part.

3. The device according to claim 2, wherein the guide gap is set based upon the thickness of the sheet bundle.

4. The device according to claim 2, wherein an adjustment amount of the mounting adjustment part is smaller than an adjustment amount of the inter-guide adjustment part.

5. The device according to claim 2, wherein the mounting adjustment part is configured to adjust the mounting gap, and the interlocking mechanism allows the inter-guide adjustment part and the mounting adjustment part to be interlocked with each other so that the mounting gap becomes gradually narrower as the guide gap becomes narrower, and the mounting gap becomes gradually wider as the guide gap becomes wider.

6. The device according to claim 1, wherein the mounting adjustment part includes an eccentric cam configured to adjust the mounting gap.

7. The device according to claim 2, wherein the inter-guide adjustment part includes a guide side cam that allows the second guide to be close to or to be away from the first guide, the mounting adjustment part includes a mounting side cam that allows the second mounting part to be close to or to be away from the first mounting part, and the interlocking mechanism includes a power transmission mechanism that transmits a rotational force of the guide side cam to the mounting side cam.

8. The device according to claim 7, wherein each of the guide side cam and the mounting side cam is positioned in one side of two regions partitioned by the sheet bundle in the sheet bundle thickness direction.

9. The device according to claim 1, wherein
the mounting adjustment part includes:
a sensor that detects the thickness of the sheet bundle; and
a control part that controls the mounting gap based upon a detection result of the sensor.

10. An image forming system, comprising:
an image forming section configured to form an image on a sheet;
a sheet stacking section configured to stack sheets to form a sheet bundle; and
a sheet binding device, comprising:
a first mounting part configured to mount a tape on an edge part of the sheet bundle;
a second mounting part opposite to the first mounting part in a sheet bundle thickness direction; and
a mounting adjustment part configured to adjust a mounting gap between the first mounting part and the second mounting part based upon a thickness of the sheet bundle,
wherein the mounting gap is equal to or smaller than the thickness of the sheet bundle before the sheet bundle is inserted between the first mounting part and the second mounting part.

11. The system according to claim 10, further comprising:
a first guide configured to guide the sheet bundle toward the mounting gap between the first mounting part and the second mounting part;
a second guide opposite to the first guide in the sheet bundle thickness direction;
an inter-guide adjustment part configured to adjust a guide gap between the first guide and the second guide; and
an interlocking mechanism configured to lock or unlock the inter-guide adjustment part with or from the mounting adjustment part.

12. The system according to claim 11, wherein
the guide gap is set based upon the thickness of the sheet bundle.

13. The system according to claim 11, wherein
an adjustment amount of the mounting adjustment part is smaller than an adjustment amount of the inter-guide adjustment part.

14. The system according to claim 11, wherein
the mounting adjustment part is configured to adjust the mounting gap, and
the interlocking mechanism allows the inter-guide adjustment part and the mounting adjustment part to be interlocked with each other so that the mounting gap becomes gradually narrower as the guide gap becomes narrower, and the mounting gap becomes gradually wider as the guide gap becomes wider.

15. The system according to claim 10, wherein
the mounting adjustment part includes an eccentric cam configured to adjust the mounting gap.

16. The system according to claim 11, wherein
the inter-guide adjustment part includes a guide side cam that allows the second guide to be close to or to be away from the first guide,
the mounting adjustment part includes a mounting side cam that allows the second mounting part to be close to or to be away from the first mounting part, and
the interlocking mechanism includes a power transmission mechanism that transmits a rotational force of the guide side cam to the mounting side cam.

17. The system according to claim 16, wherein
each of the guide side cam and the mounting side cam is positioned in one side of two regions partitioned by the sheet bundle in the sheet bundle thickness direction.

18. The system according to claim 10, wherein
the mounting adjustment part includes:
a sensor that detects the thickness of the sheet bundle; and
a control part that controls the mounting gap based upon a detection result of the sensor.

19. A sheet binding method, comprising:
mounting a tape on an edge part of a sheet bundle using a first mounting part, the first mounting part opposite to a second mounting part in a sheet bundle thickness direction;
adjusting a mounting gap between the first mounting part and the second mounting part based upon a thickness of the sheet bundle using a mounting adjustment part, wherein the mounting gap is equal to or smaller than the thickness of the sheet bundle before the sheet bundle is inserted between the first mounting part and the second mounting part; and
inserting the sheet bundle having the tape on the edge part between the first mounting part and the second mounting part.

20. The method according to claim 19, further comprising:
guiding the sheet bundle toward the mounting gap between the first mounting part and the second mounting part using a first guide, the first guide opposite to a second guide in the sheet bundle thickness direction;
adjusting a guide gap between the first guide and the second guide using an inter-guide adjustment part; and
interlocking the inter-guide adjustment part with the mounting adjustment part.

* * * * *